US005224855A

United States Patent [19]

Toyonaga et al.

[11] Patent Number: 5,224,855

[45] Date of Patent: Jul. 6, 1993

[54] GAS BURNER

[75] Inventors: Hajime Toyonaga; Toshio Nishida; Yasuo Takeishi; Masao Shiomi, all of Osaka, Japan

[73] Assignee: Osaka Gas Co., Ltd., Osaka, Japan

[21] Appl. No.: 720,592

[22] Filed: Jun. 25, 1991

Related U.S. Application Data

[62] Division of Ser. No. 315,909, Feb. 27, 1989, Pat. No. 5,073,106.

[30] Foreign Application Priority Data

| | | | |
|---|---|---|---|
| Feb. 27, 1988 | [JP] | Japan | 63-45494 |
| Nov. 17, 1988 | [JP] | Japan | 63-291731 |
| Nov. 28, 1988 | [JP] | Japan | 63-300246 |
| Dec. 23, 1988 | [JP] | Japan | 63-326917 |

[51] Int. Cl.[5] ..... F23M 3/06; F23D 14/12

[52] U.S. Cl. ..... 431/285; 431/278; 431/12; 431/328; 126/92 R

[58] Field of Search ..... 431/7, 12, 285, 328, 431/278, 170, 285; 126/92 R, 92 AC

[56] References Cited

U.S. PATENT DOCUMENTS

| | | | |
|---|---|---|---|
| 1,830,464 | 11/1931 | Guenther | 431/285 |
| 2,122,132 | 6/1938 | Docking | 431/328 |
| 2,428,274 | 9/1947 | Flynn et al. | 431/278 |
| 3,077,922 | 2/1963 | Soucie | 431/328 X |
| 4,674,973 | 6/1987 | Wright | 431/284 |

FOREIGN PATENT DOCUMENTS

| | | | |
|---|---|---|---|
| 2044813 | 9/1970 | Fed. Rep. of Germany . | |
| 2745687 | 4/1979 | Fed. Rep. of Germany | 431/278 |

*Primary Examiner*—Carl D. Price

*Attorney, Agent, or Firm*—Glifford, Groh, Sprinkle, Patmore and Anderson

[57] ABSTRACT

A gas burner having first flame openings for discharging a stable and self-combustible high-concentration gas and second flame openings for discharging a unstable and non-self-combustible low-concentration gas, with the first and second flame openings being disposed alternately with each other. The effect of stable flame formations at the first flame openings assists stabilization of flame formations at the second flame openings adjacent thereto. Consequently, the gas burner as the whole may have a high air excess ratio to reduce its NOx generation and to prevent incomplete combustion. Further, if a rectifying member is provided in the second flame opening, it becomes possible to enlarge the opening area of the second flame opening without disturbing its flame formation, whereby the burner will achieve further reduction in NOx generation and combustion noise and also improvements in its combustion load and ignition performance.

11 Claims, 26 Drawing Sheets

GAS BURNER

This is a divisional of copending application Ser. No. 07/315,909 filed on Feb. 27, 1989, now U.S. Pat. No. 5,073,106.

BACKGROUND OF THE INVENTION

1. Field of the Invention

The present invention relates to a gas burner including a plurality of flame openings aligned in a parallel arrangement for discharging a mixture of a fuel gas and combustion air.

2. Description of the Prior Art

According to a known gas burner, as shown in FIG. 37, a mixer 403 is connected to a burner body 402 with a plurality of flame openings formed by means of a multi-pore plate member 401. In operation, the mixer 403 mixes a fuel gas from a pipe passage 404 with a combustion air from a blower 8 to feed in distribution a same mixture gas, which has a stable self-combustible air-fuel ratio (air excess ratio:=1.2 to 1.5), to all the flame openings to be burned on the surface of multi-pore plate member 401. Such construction is known from e.g. U.S. Pat. No. 4,480,988.

However, with the above-described gas burner, there tends to occur lift phenomenon in the flame in association with increased load in the combustion chamber. Further, there often occurs incomplete combustion in association with a change in the air excess ratio. Thus, the burner still has room for improvement in terms of extension in the turn-down ratio and of combustion stability. Also, it has been very difficult for the above gas burner to satisfactorily achieve all of the desired performances of low NOx and noise generations and a high load combustion.

More specifically, if the air excess ratio is increased within the stable self-combustible range in order to sufficiently reduce the NOx generation, this will disturb the stability of flame formation to generate a greater combustion noise and also to disadvantageously reduce the heat generation and consequently the combustion load. Reversely, if the air excess ratio is decreased in order to increase the combustion load, this will increase the temperature of flames thereby to increase the NOx generation. Moreover, since such high temperature region will be formed most conspicuously in the immediate vicinity of the surface of the multi-pore plate member 401, the resonance inside the burner body 402 will increase, whereby the burner will generate a greater noise in this case also.

Further, when the burner is first ignited, since the surface of the multi-pore plate member 401 is at a low temperature, there occurs insufficient surface combustion, which tends to lead to incomplete combustion.

SUMMARY OF THE INVENTION

The first object of the present invention is to provide an improved multi-flame-opening type gas burner capable of increasing combustion chamber load while restricting flame lift and maintaining complete combustion condition even with a significant change in the air excess ratio, whereby the burner may achieve a sufficiently high turn-down ratio and superior combustion stability.

The second object of the invention is to provide a gas burner which may achieve all of the low NOx generation, low noise generation and the high combustion load and which may also reliably prevent occurrence of incomplete combustion at the time of ignition.

In order to accomplish the above objects, according to a first characterizing feature of the present invention, in a gas burner of the above-described type including a plurality of first flame openings for discharging a high-concentration mixture gas containing a relatively large amount of fuel gas and a combustion air and a plurality of second flame openings for discharging a low-concentration mixture gas with a higher air excess ratio than that of the high-concentration mixture gas, with the first flame openings and the second flame openings being arranged alternately with each other.

According to a second characterizing feature of the invention, each second flame opening includes a plurality of rectifying members for sectioning all or most of the interior of the second flame opening into a plurality of sections having a width no greater than 2 mm; and all or most of adjacent pairs of the first flame openings are spaced with an interdistance therebetween not less than 8 mm.

According to a third characterizing feature of the invention, the interdistance between an adjacent pair of first flame openings is maintained at 20 to 40 mm. And, preferably, the width of each section formed by the rectifying members is maintained at 0.7 to 1.3 mm.

The inventors conducted varied experiments for seeking effective means for preventing the lift phenomenon of flame with increased combustion chamber load and incomplete combustion with a change in the air excess ratio. Then, it was found out that both of these inconveniences may be overcome at one time by supplying the high-concentration gas to one of the adjacent pair of flame opening while supplying the low-concentration gas to the other of the flame opening rather than supplying the same mixture gas to the both.

Also, the inventors conducted further experiments on the gas burner with the first characterizing feature of the invention to achieve all of the low NOx generation, low noise generation, high combustion load and stable flame formation at the time of burner ignition in the multi-flame-opening type gas burner. The experiments revealed the following facts:

(a) As the gas burner includes the first flame openings F1 for discharging a mixture gas capable of stable self-combustion and with a low air excess ratio and the second flame openings F2 for discharging a mixture gas incapable of stable self-combustion and with a high air excess ratio disposed alternately with each other, the effect of stable flame formations at the first flame openings F1 assist stabilization of flame formations at the second flame openings F2. However, when it was attempted to increase the opening area of the second flame opening F2 (as shown e.g. in FIG. 4) in order to increase the air excess ratio of the mixture gases combined, the flame formations at the second flame openings F2 were significantly disturbed and incomplete combustion occurred. Then, if the second flame opening is divided by the rectifying members into sections each with a width not greater than 2 mm, ranging preferably 0.7 to 1.3 mm, by the rectifying effect of the rectifying members the flame formations at these second flame openings were stabilized and a total high-temperature region was formed over an extended area L as shown e.g. in FIG. 1.

Using the mixture gas of the natural gas and the air, it was also investigated to what degree the fuel gas concentration in the mixture gas may be reduced without disturbing the stability of the flames. The results are shown in FIG. 5.

The results reveal that the fuel gas concentration may be reduced down to 2% which is significantly lower than the ordinarily believed lower limit of 5%.

(b) If the interdistance of the first flame opening pair exceeds 8 mm, ranges preferably between 20 and 40 mm, even if the second flame opening has an opening area considerably larger than that of the first flame opening, the proportion of the low-concentration gas from the second flame opening may be increased relative to the high-concentration gas from the first flame opening, whereby the total air excess ratio of the two kinds of mixture gas combined may be increased to lower the flame temperature and consequently the NOx generation may be sufficiently suppressed. Specifically, the NOx generation in the theoretical air ratio of the conventional gas burner was measured to be 20 ppm approximately. On the other hand, according to the present invention, the air excess ratio was increased to about 1.9 and the NOx generation was reduced down to 10 ppm approximately.

(c) As described in the above section (a), since the flames from both the first and second flame openings are stabilized, the combustion noise associated with unstable flame formation may be advantageously reduced. Further, since the high temperature region may be extended as described in the section (a) and also the temperature of the flames may be reduced as described in the above section (b), the resonance of the burner body from the burning flames may be reduced as the whole.

(d) Since the flame of the second flame opening may be stabilized as described in the above section (a) and also since the combustion resonance may be sufficiently suppressed as described in the section (c), it becomes possible to increase the combustion load by increasing the amount of mixture gas supplied to the second flame openings. Specifically, in contrast to the conventional combustion load value of 100 kcal/cm$^2$ Hr, the present invention increased the same up to the vicinity of 300 kcal/cm$^2$ Hr.

(e) As described in the section (a), since the high temperature region may be extended; namely, the flames may be formed fairly distant from the first and second flame openings, the material forming these openings may be free from adverse influence of the high temperature which in turn will adversely affect the combustion conditions, whereby a good combustion condition without incomplete combustion may be achieved even at the time of burner ignition.

As the results, the present invention has achieved an improved gas burner capable of achieving high performances in all terms of NOx generation, noise generation, combustion load and ignition characteristics.

With the above-described gas burner; however, if the average air excess ratio of the entire burner exceeds a certain value, it is possible for the flame of the high-concentration gas to be inadvertently extinguished by the effect of the adjacent flames of low-concentration gas. In this respect, the reduction of NOx generation of this gas burner is limited.

Then, the third object of the present invention is to further lower the NOx generation without entailing such inconvenience by means of simple additional arrangement.

In order to accomplish the above object, according to a fourth characterizing features of the invention's gas burner, there is provided a flame-retaining portion in the opening array direction of the first and second flame openings, with the flame-retaining portion being adapted for reducing a flow speed of the high-concentration gas at this portion.

With the above flame-retaining portion, the high-concentration gas may be burned in a very stable manner without being adversely affected by the adjacent flames of the low-concentration gas. Accordingly, even if the average air excess ratio of the high-concentration mixture gas and the low-concentration mixture gas is increased, it is still possible to effectively prevent inadvertent extinction of the high-concentration mixture gas, whereby the NOx generation may be further reduced without entailing any inconvenience.

Moreover, in the gas burner of the above-described type, there tends to occur incomplete combustion leading to an increase in CO generation because a portion of the low-concentration gas discharged through the peripheries of the flame openings is not significantly influenced by the effect of the high-concentration gas flames of the high-concentration gas flame openings.

Such problem of incomplete combustion of low-concentration mixture gas may be also effectively suppressed by the above arrangement of the present invention.

Further, the above-described gas burner tends to be physically large and costly because it must be accompanied by the two mixers for preparing the high-concentration mixture gas and the low-concentration mixture gas, respectively.

Then, according to the present invention, the simple construction which only necessitates the different kinds of plate members may substitute both or at least either of the two mixers, whereby the costs of the burner per se may be reduced and the entire combustion system may be formed compact.

Further and other objects, constructions and effects of the present invention will become apparent from the following detailed description of the preferred embodiments with reference to the accompanying drawings.

DESCRIPTION OF THE PREFERRED EMBODIMENTS

Preferred embodiments of the present invention will be particularly described hereinafter with reference to the accompanying drawings.

Figure 1:
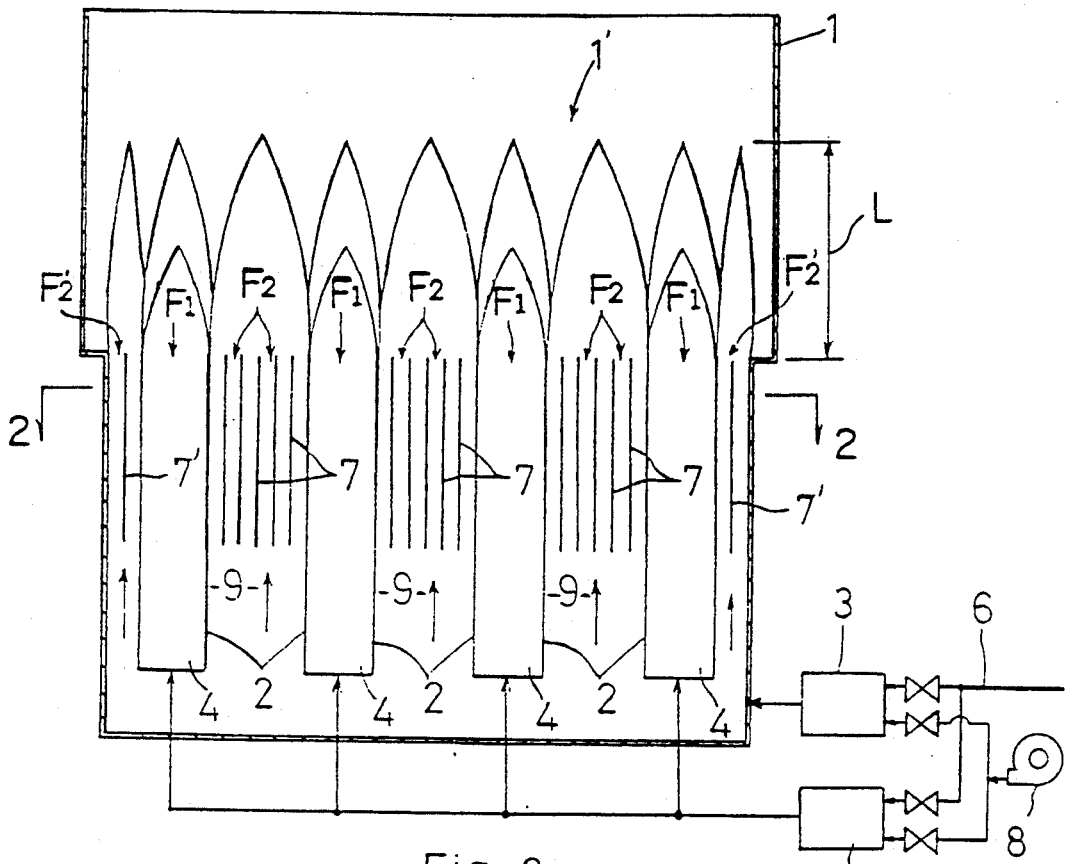
FIGS. 1 and 2 show a preferred embodiment of the present invention, with FIG. 1 being a general conceptual view and FIG. 2 being a perspective view taken along a line II—II of FIG. 1, FIGS. 3(*a*) and 3(*b*) are views of major portions according to an alternate embodiment of the invention.
Figure 2:
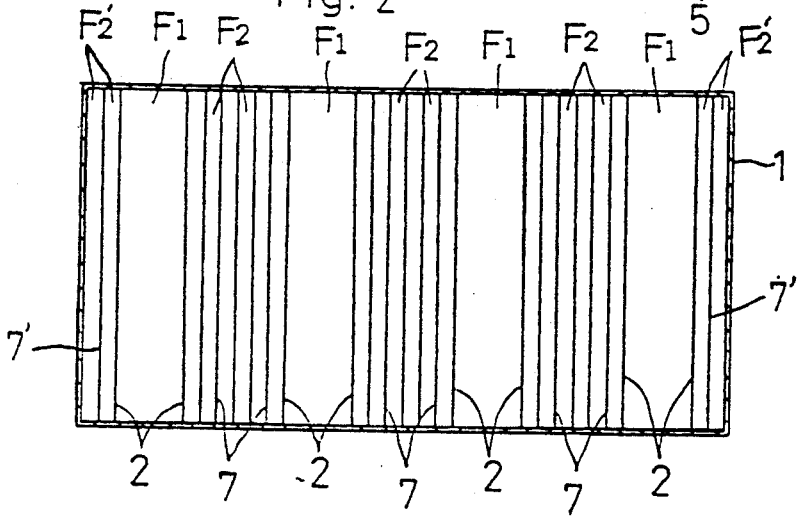

In a first embodiment shown in FIGS. 1 and 2, inside a vertically-oriented cylindrical casing 1 formed of a plate metal or the like, there are arranged in parallel with each other a plurality of partition walls 2 for partitioning a small-diameter lower portion of the casing into a plurality of horizontal sections. These partition walls 2 are paired with one adjacent the other to form a narrow and long rectanglar-shaped first flame opening F1 therebetween. Further, the partion walls 2 are so positioned as to allow an adjacent pair of first flame openings F1 to be spaced with an interdistance of no less than 8 mm, preferably 20 to 40 mm.

The first flame openings F1 are communicated with first flow passages 4 all of which are parallel-connected to a first mixer 5. In this first mixer 5, a fuel gas from a pipe 6 and an air from a blower 8 are mixed to produce a mixture gas having a gas concentration within a stable and self-combustible range.

An air excess ratio of the mixture gas fed from the first mixer 5 to the first flame openings F1 ranges generally between 0.3 and 1.2. Also, the feed amount of the mixture gas to the first flame openings F1 is so set as to provide a frame opening load of approximately 5 Kcal/mm$^2$ Hr.

Further, there are provided a plurality of rectifying plates 7 for horizontally partitioning adjacent pairs of first flame openings F1 so as to form therebetween a plurality of narrow, long and rectanglar-shaped second flame openings F2 aligned in parallel with the first flame openings F1. The rectifying plates are so positioned that each formed second flame opening F2 has a maximum width no greater than 2 mm, preferably 0.7 mm to 1.3 mm.

The second flame openings F2 positioned in between the first flame openings F1 are communicated with second flow passages 9 all of which are parallel-connected to a second mixer 3. In this second mixer 3, the fuel gas from the pipe 6 and the air from the blower 8 are mixed to produce a further mixture gas having a gas concentration below a stable and self-combustible range. An air excess ratio of this further mixture gas fed from the second mixer 3 to the second flame openings F2 ranges generally between 2 and 4. Also, the fuel gas concentration is set below or at the vicinity of an explosion lower limit value, depending on the kind of gas.

Between the rightmost partion wall 2 and the right side wall of the casing 1 and also between the leftmost partion wall 2 and the left side wall of the same, there are provided further rectifying plates 7' for forming an auxiliary flame opening F2', which is structurally similar to the second flame opening F2, with further sectioning the interspace into two subsections, respectively. These auxiliary flame openings F2' are connected to the second mixer 3 and serve to provide additional air for assisting complete combustion of the flames formed at the side-end first flame openings F1.

Incidentally, the first, second and auxiliary flames openings F1, F2 and F2' are all disposed on the same plane to face a combustion chamber 1'.

Experiment

An experiment was conducted with using the gas burner of the above-described embodiment. In this embodiment, a natural gas with heat-generating amount of 11,000 kcal/cm$^3$ was used as the fuel gas. Then, two kinds of mixture gas were prepared using this fuel gas; namely, a mixture gas containing 12.1% natural gas to be fed to the first flame openings F1 and a further mixture gas containing 4.6%, which is lower than the explosion lower limit value of 5%, to be fed to the second and third flame openings F2 and F3, with maintaining the total air excess ratio at 1.75.

As the result, the gas burner provided stable combustion when the average combustion surface load was 170 kcal/cm$^2$ Hr, while the NOx generation was sufficiently limited at a theoretical air ratio of 10 ppm and the combustion noise generation was substantially negligible.

Figure 6:
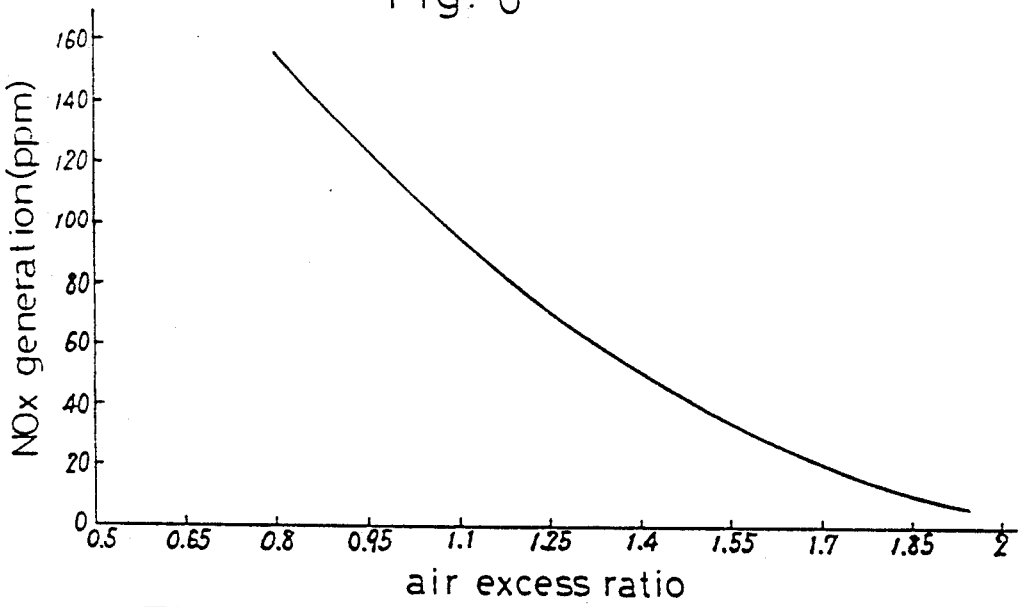
Figure 37:
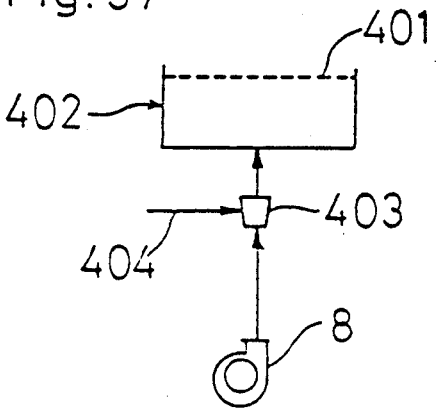
FIG. 37 is a conceptual view showing the prior art.

Further, the relationship between the NOx generation and the air excess ratio was investigated, which results are shown in FIG. 6.

In the above, the total combustion surface load was measured as 100 to 300 kcal/cm$^2$ Hr.

Figure 3A:
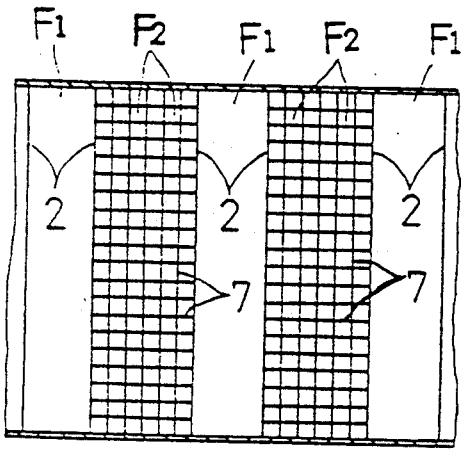
Figure 3B:
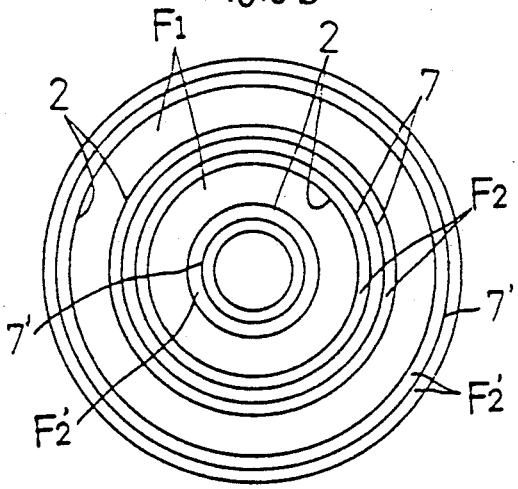
Figure 4:
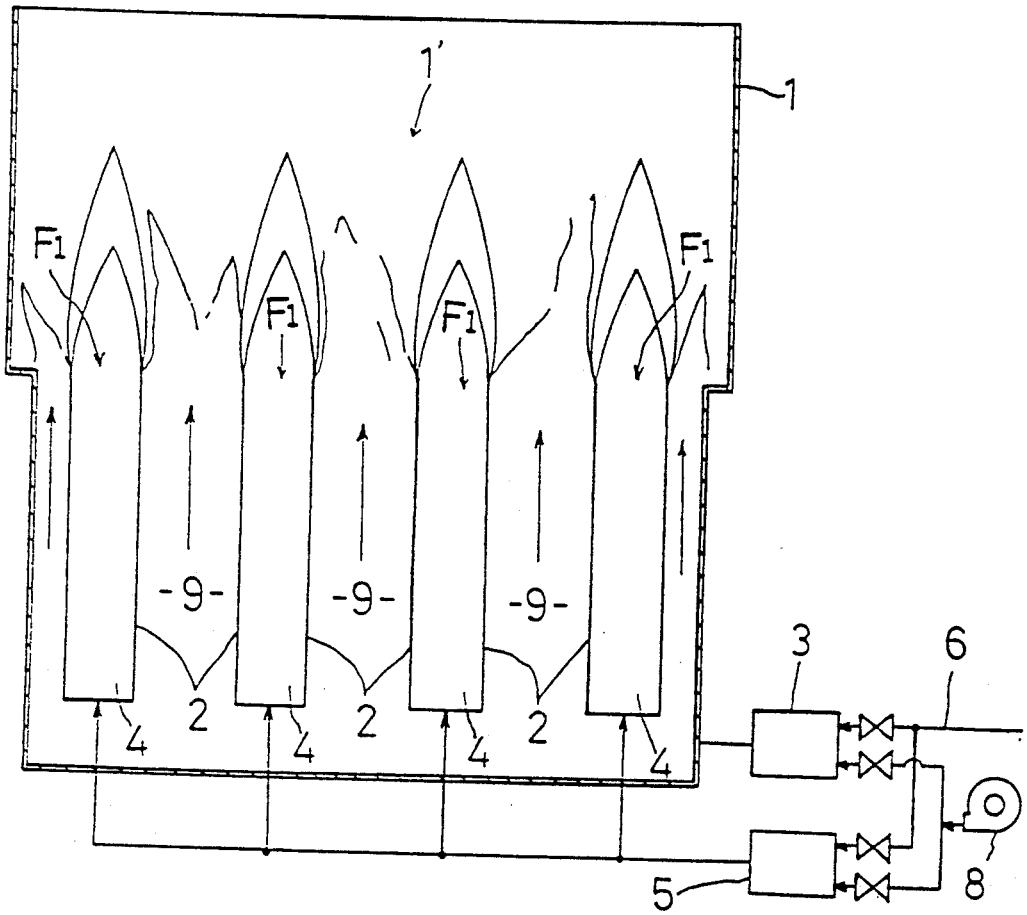
FIG. 4 is a conceptual view for comparison.
Figure 5:
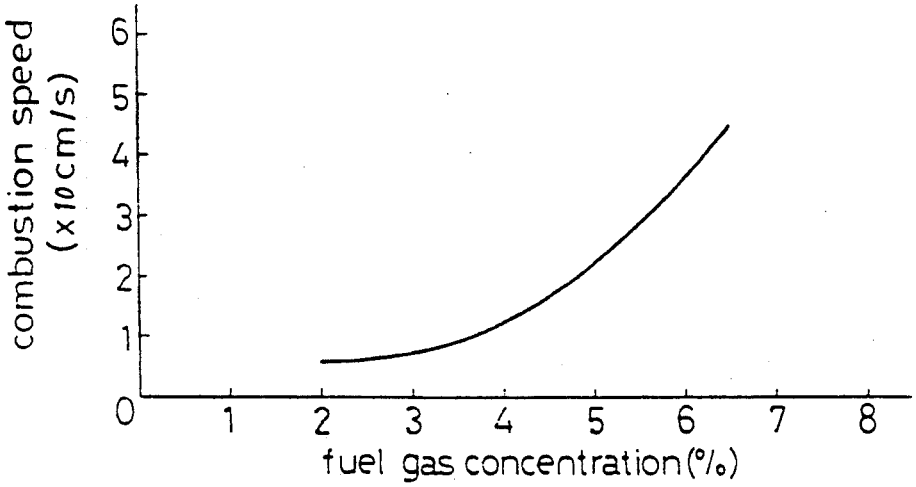
FIG. 5 and FIG. 6 are graphs illustrating results of experiments.

The configurations, positionings and dimensions of the first flame opening F1 and the second flame opening F2 may be conveniently varied as listed (a) through (e) below:

(a) As shown in FIG. 3(*a*), the rectifying plates 7 may be arranged in the form of grating to align the second flame openings F2 in the vertical and lateral directions.

(b) As shown in FIG. 3(*b*), the partition walls 2 and the rectifying plates 7 may be formed cylindrical to be coaxially arranged.

(c) The first flame openings F1 may be aligned in the form of grating, with vertically-aligned openings crossing laterally-aligned openings.

(d) The interdistances between some adjacent pairs of first flame openings F1 may be below 8 mm.

(e) Some of the second flame openings F2 may have a width exceeding 2 mm.

That is to say, the various modifications are possible in the formation and arrangement of the rectifying plates 7. These rectifying plates 7 between an adjacent pair of first flame openings F1 will be generically referred to as rectifying members 7 hereinafter.

Further, the type of fuel gas is selectable; for instance, coal type city gas, propane gas or the like may be employed instead of the natural gas. The fuel gas concentrations in the mixture gases to be fed to the first flame openings F1 and the second flame openings F2 may be conveniently varied depending on the type of fuel gas employed. The specific means for adjusting the fuel gas concentrations may vary also. These means will be generically referred to as fuel gas concentration adjusting means 5 and 3 hereinafter.

Moreover, it is conceivable to provide means for mixing an appropriate amount of combustion exhaust gas into the second flame openings F2 for the purpose of reducing the air excess ratio.

Next, referring to FIGS. 7 through 16, alternate embodiments using a flame-retaining portion of the present invention will be specifically described hereinafter.

Figure 7:
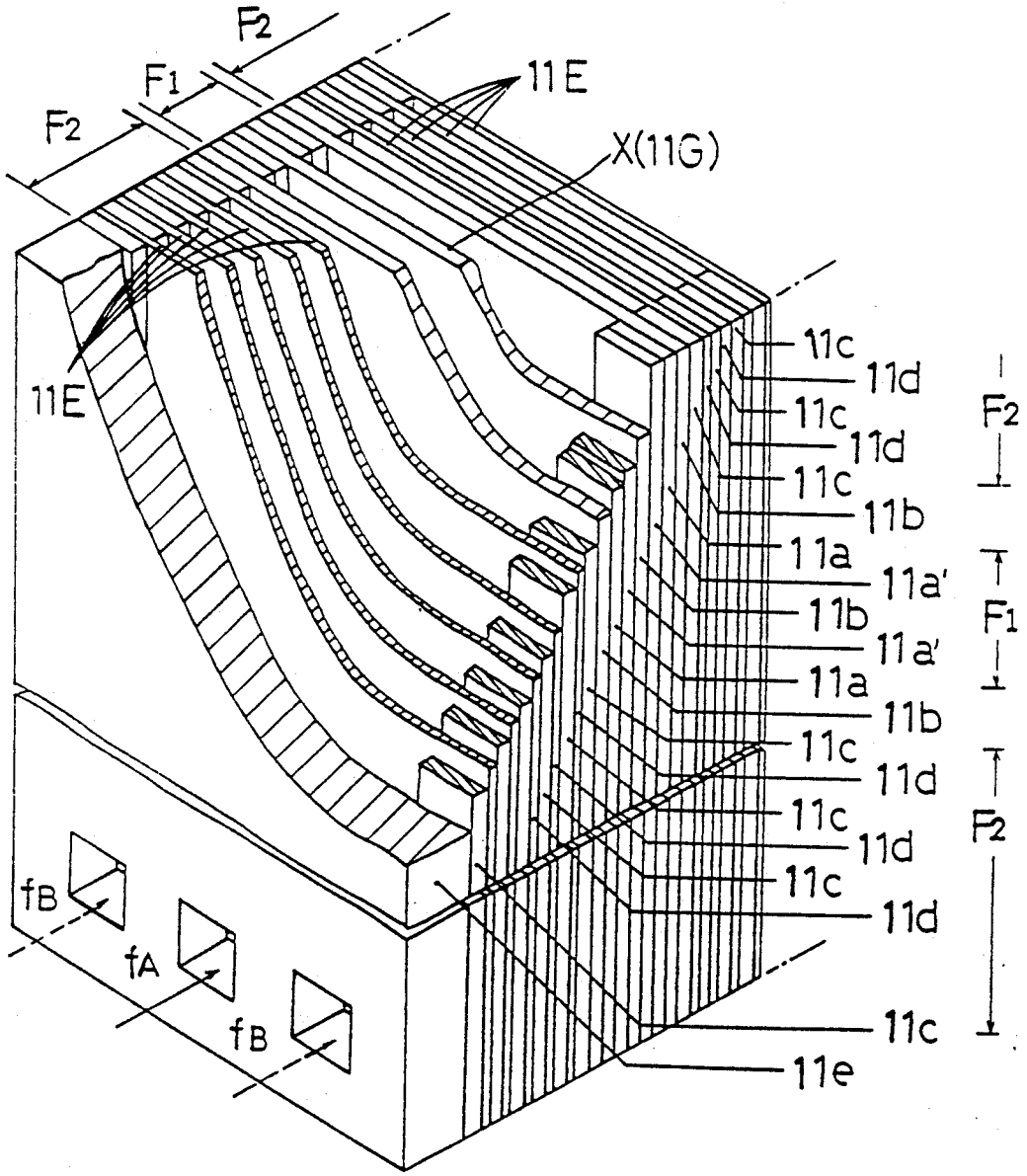
FIGS. 7 through 10 show a further alternate embodiment of the invention, with FIG. 7 being a partially cutaway perspective view, FIG. 8 being a plan view, FIG. 9 being an enlarged section, and FIGS. 10(*a*), 10(*b*) and 10(*c*) being views of constituting elements, respectively.
Figure 8:
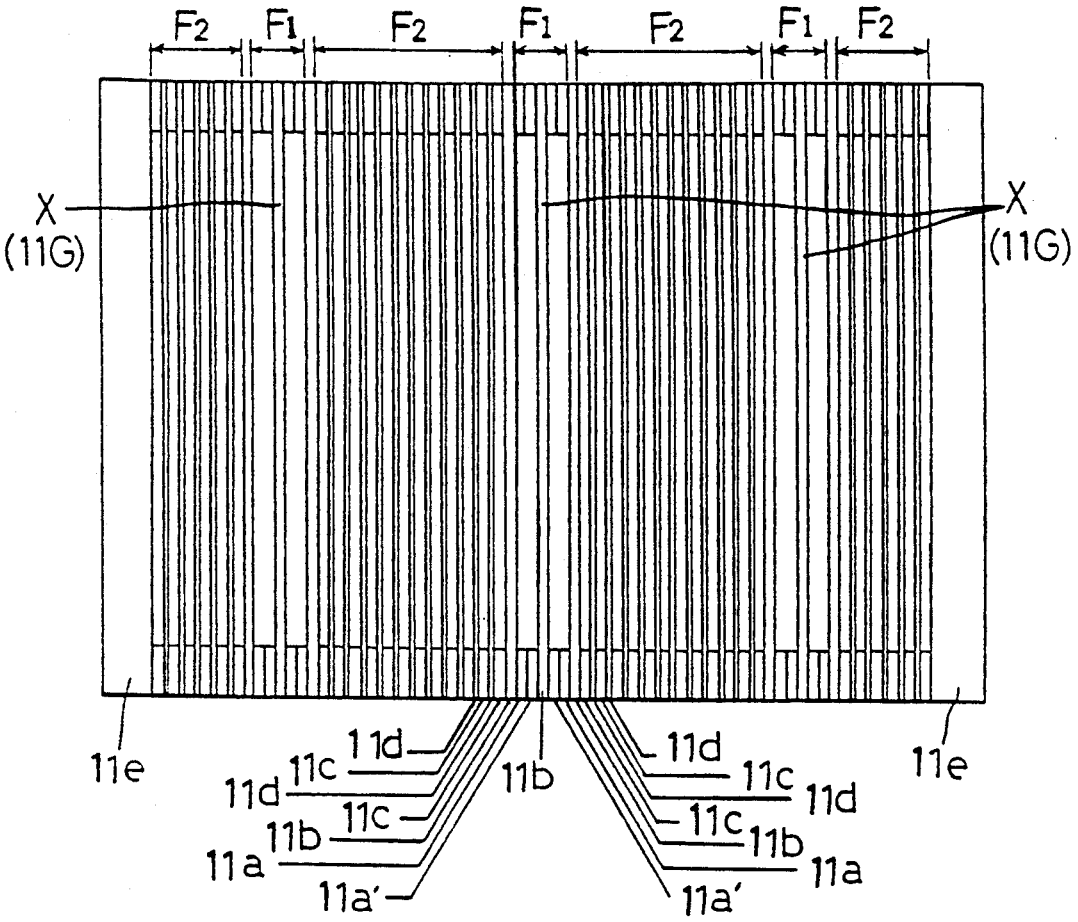
Figure 9:
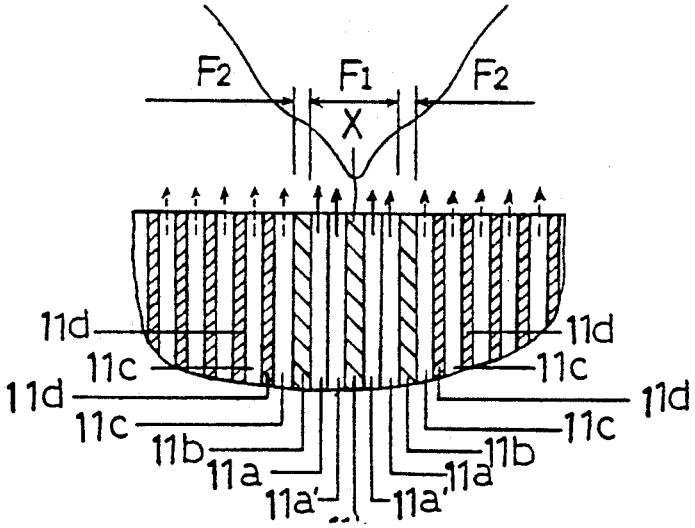
Figure 10A:
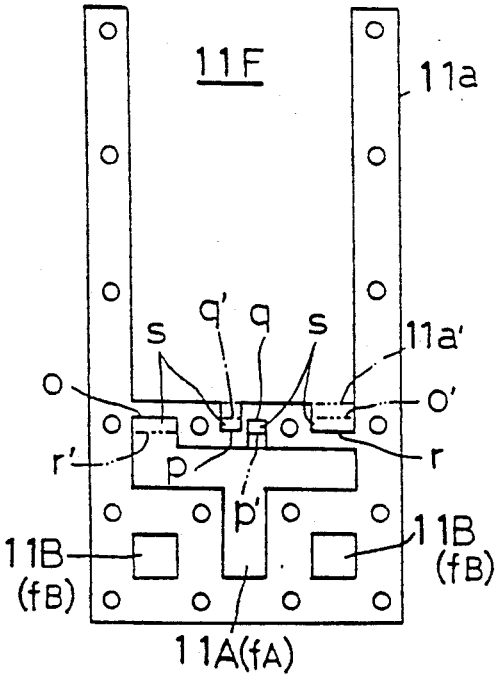
Figure 10B:
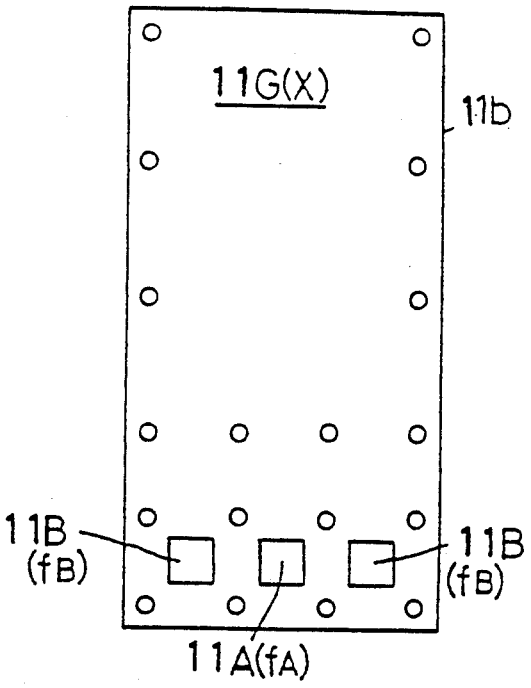
Figure 10C:
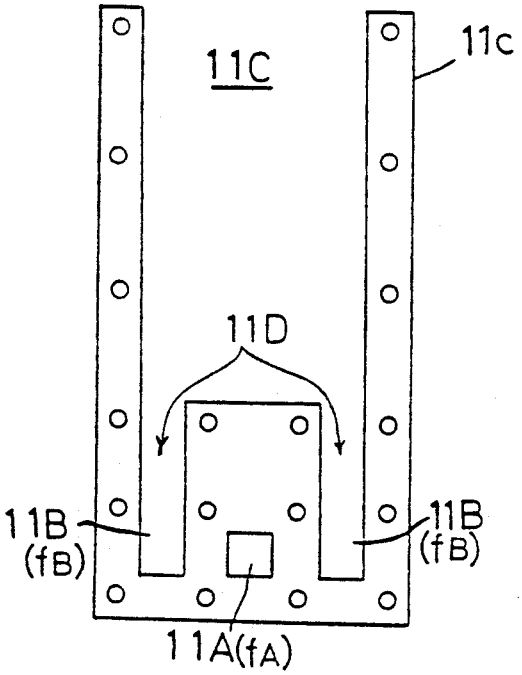
Figure 10D:
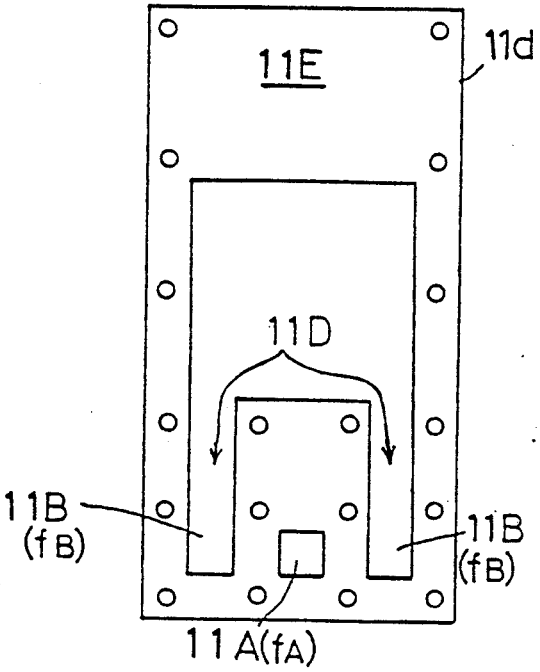

FIGS. 7 and 8 show a multi-flame-opening type gas burner. This gas burner includes first through fourth plate members 11*a*, 11*b*, 11*c* and 11*d* respectively shown in FIGS. 10(*a*), 10(*b*), 10(*c*) and 10(*d*) disposed in a an overlapping arrangement of a predetermined order and bound together by means side end plates 11*e*.

When the plate members 11*a*, 11*b*, 11*c* and 11*d* are placed into the overlapped arrangement, opening portions 11A thereof communicate with each other to form together with a high-concentration gas passage fA and also further opening portions 11B communicated with each other to form together with a low-concentration gas passage fB.

Into these high-concentration gas passage fA and low-concentration gas passage fB, mixture gases of fuel gas and combustion air are separately supplied through different holes defined in the one side end plate 11*e*. More particularly, the high-concentration gas passage fA is supplied with a high-concentration mixture gas (indicated by an arrow of solid line) having a high gas concentration within a stable self-combustible range; whereas, the low-concentration gas passage fB is supplied with a low concentration mixture gas (indicated by an arrow of broken line) having a low gas concentration below the stable self-combustible range.

On the other hand, the burner body includes two types of flame openings, i.e. first flame openings F1 for discharging the high-concentration mixture gas and second flame openings F2 for discharging the low-concentration mixture gas. More particularly, the second flame opening F2 is formed in between a pair of second plate members 11*b* binding therebetween a plurality of the third plate members 11*c* and the fourth plate members 11*d* alternately overlapped with each other, and has its discharge opening formed by upper end opening portions 11C of the respective third plate members 11*c*.

The low-concentration mixture gas is supplied via opening portions 11D of the respective third plate members 11*c* and the fourth plate members 10*d* from the low-concentration gas passage fB to the respective discharge opening portions 11C of the second flame opening F2, in which upper end plate portions 11E of the respective fourth plate members 11*d* act as rectifying plates in the second flame opening F2.

On the other hand, the first flame opening F1 is formed in between a pair of the second plate members 11*b* binding therebetween a plate group consisting of the forward-oriented first plate member 11*a*, reverse-oriented first plate member 11*a*', the second plate member 11*b*, reverse-oriented first plate member 11*a*' and the forward-oriented first plate member 11*a* overlapped each other in this order, and has its discharge opening formed by upper end opening portions F of the respective first plate members 11*a* and 11*a*'.

The first plate member 11*a* defines four cutout portions o, p, q and r, such that the high-concentration mixture gas passes through a space s formed by overlappings of the cutout portions o, p, q and r of the forward-oriented plate member 11*a* and cutout portions o', p', q' and r' of the reverse-oriented first plate member 11*a*' to be supplied from the high-concentration mixture gas passage fA to the respective discharge opening portions F of the first flame opening F1.

The entire gas burner includes a plurality of the above-described first flame openings F1 for discharging the high-concentration mixture gas and a plurality of the second flame openings F1 for discharging the low-concentration mixture gas, with the first flame opening and the second flame openings being arranged alternately each other with their second plate members 11*b* acting also as separators between adjacent pairs. That is, in this alternate arrangement, one first flame opening F1 is sided by a pair of the second flame openings F2.

In operation, by the effect of the stable flame (flame of stable self-combustible high-concentration mixture gas) formed at the first flame opening F1, the adjacent second flame openings F2 may also form stable flames of the low-concentration mixture gas. Accordingly, even though the low-concentration mixture gas incapable of stable self-combustion is employed, the the burner as the whole may provide stable combustion flame formation.

Then, by using such low-concentration mixture gas in combination with the high-concentration mixture gas, it becomes possible for the gas burner on the whole to function with a higher air excess ratio in the mixture gas and to achieve lower NOx generation.

In forming the first flame opening F1, an upper plate portion 11G of the second plate member 11*b* positioned centrally of the first flame opening F1 as being bound by the forward-oriented first plate member 11*a* and the reverse-oriented first plate member 11*a*', acts as a flame-retaining portion X (see FIG. 9) for forming a low flow-speed region of the high-concentration gas at a portion where the upper end of this upper plate portion 11G on the flame opening surface. With this flame-retaining portion X disposed centrally of the first flame opening in the opening array direction for reducing the gas flow speed at this portion relative to its side portions, even if the average air excess ratio between the high-concentration mixture gas and the low-concentration mixture gas is increased, it is possible to maintain stable combustion of the high-concentration mixture gas at the center portion of the first flame opening F1, and consequently it becomes possible to avoid inadvertent extinction of the flame of high-concentration mixture gas due to the effect of the adjacent flames of low-concentration mixture gas.

In other words, according to the above arrangement, the average air excess ratio between the high-concentration mixture gas and the low-concentration mixture gas may be further increased. Then, the air excess ratio of this gas burner as the whole may also be increased for more effectively achieving lower NOx generation.

Incidentally, as specific setting values of the above air excess ratios, the ratio in the high-concentration mixture gas may be set as 1.1 to 1.4 while setting that in the low-concentration mixture gas at 1.6 to 4.0. However, in order to optimize the balance between the two ratios for achieving low NOx generation and stable combustion in practical use, the air excess ratio of the high-concentration mixture gas should preferably range between 1.2 to 1.3 while that of the low-concentration mixture gas should be set at 2.0 approximately.

Figure 15:
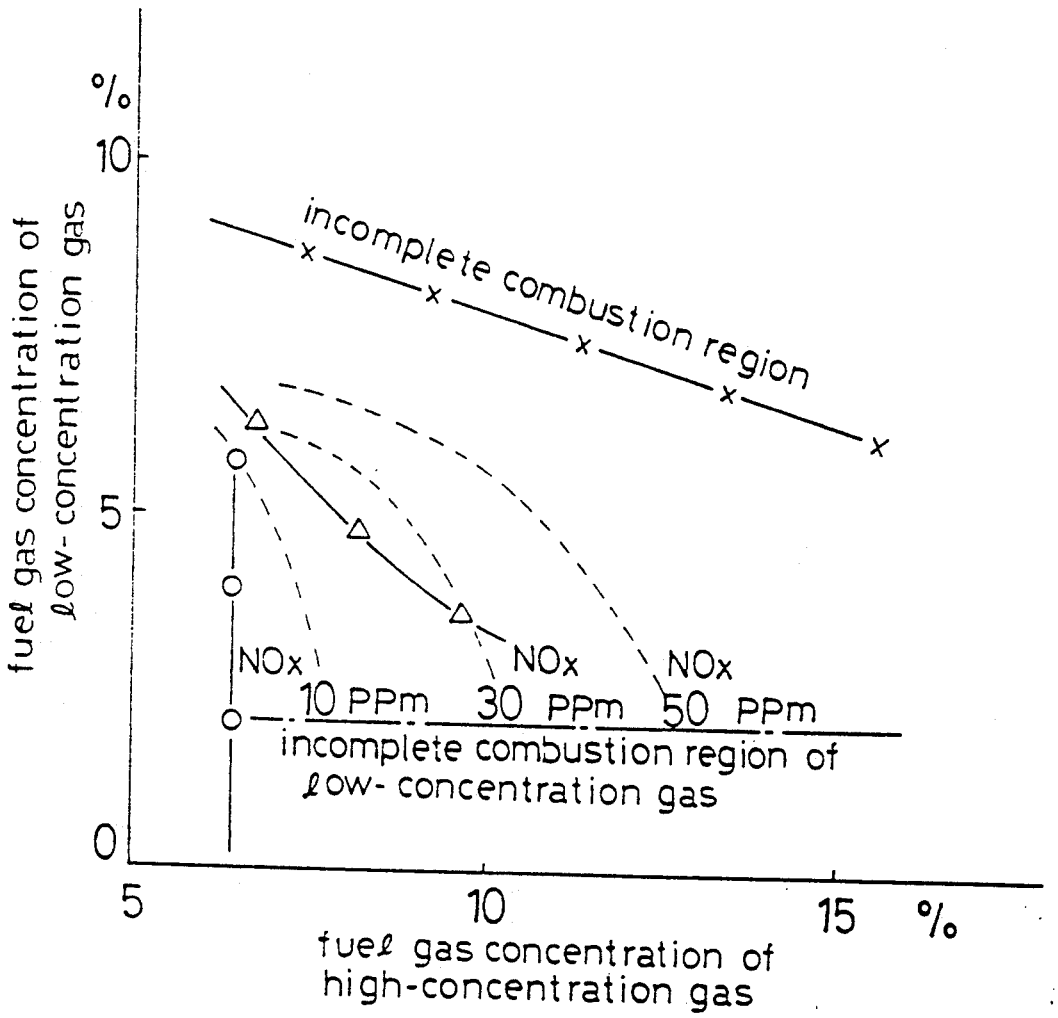
FIG. 15 is a graph showing experiment results, FIGS. 16(*a*) and 16(*b*) illustrate combustion conditions.
Figure 17A:
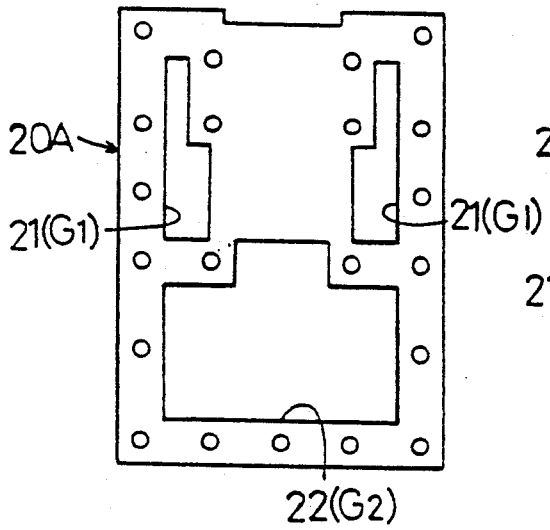
FIGS. 17 through 19 show still further embodiment of the invention, with FIGS. 17(*a*), 17(*b*) and 17(*c*) being views of constituting elements FIG. 17(*d*) being a view of an end plate, FIG. 18 being a partially cutaway perspective view and FIG. 19 being a plan view, respectively, FIGS. 20 through 25 respectively show further embodiments of the invention, with FIGS. 20 and 21 being plan views, FIGS. 22 and 23 being perspective views, FIG. 24 being a plane view and FIG. 25 being a section taken along a line IX—IX of FIG. 24, FIGS. 26 through 28 show further embodiments of the invention, with FIGS. 26(*a*), 26(*b*) and 26(*c*) showing constituting elements, FIG. 27 being a partially cutaway perspective view and FIG. 28 being a section taken along a line III—III in FIG. 1, respectively.
Figure 17B:
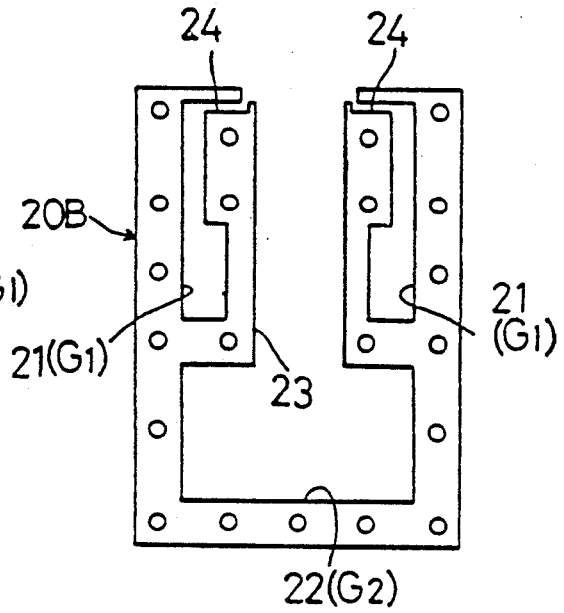
Figure 17C:
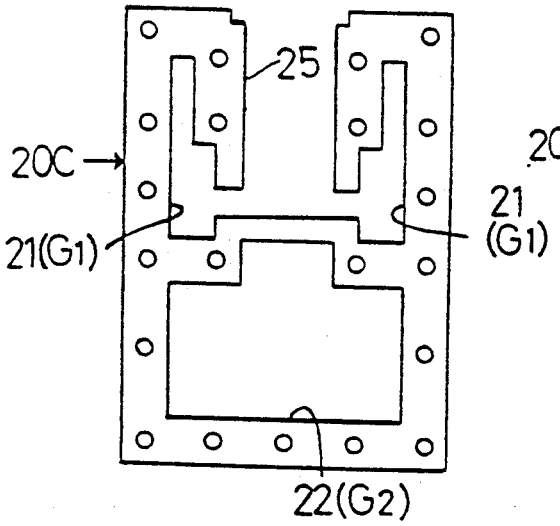
Figure 17D:
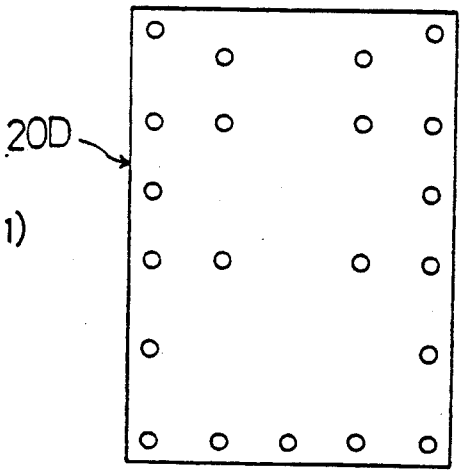

FIG. 15 shows results of an experiment where 13A gas ($CH_4$88%, $C_2H_6$6%, $C_3H_8$4%, $C_4H_{10}$2%) was employed as the fuel gas and burnt at 5,000 kcal/h. In the drawing, a line —Δ—Δ— denotes a limit of stable combustion (beyond which extinction of the high-concentration gas flame occurs) when no flame-retaining portions are provided in the first flame openings, a line —○—○— denotes the limit when the flame-retaining portions are provided therein according to the invention. This shows, with the present invention, that the burner may properly operate in the region between the defined two limits and that the upper limit of the average air excess ratios of the high-concentration mixture gas and of the low-concentration mixture gas has been effectively increased (i.e. the lower limit of the average air excess ratio of the high-concentration mixture gas and the low-concentration mixture gas has been effectively reduced).

Also, an observation into the relationship with the NOx generation shown in FIG. 15 will show that the NOx generation may be reduced to approximately 30 ppm without the flame-retaining portions while the same may be reduced to as low as 10 ppm or lower with the flame-retaining portions of the invention.

Figure 16A:
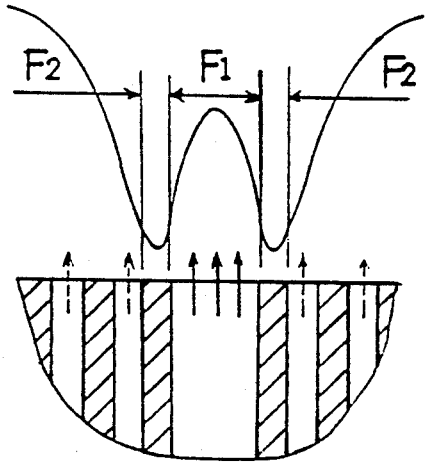
Figure 16B:
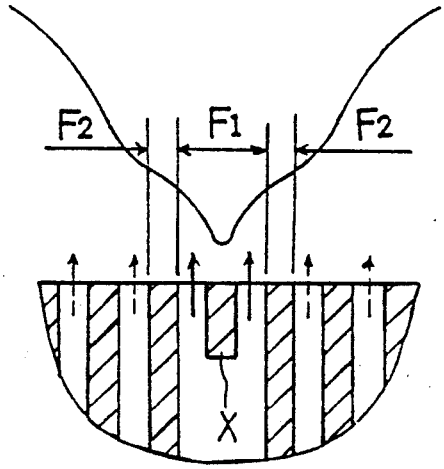

The flame forming condition within the stable combustion range when no flame-retaining portions are provided is illustrated in FIG. 16(*a*). With the present invention; on the other hand, the flame forming condition at the region between the measured limits of —Δ—Δ— and —○—○— in FIG. 15 is illustrated in FIG. 16(*b*). This also shows that the flame-retaining portion X disposed centrally of the first flame opening contributes significantly to the stability of the high-concentration mixture gas flame and consequently to the prevention of inadvertent extinction of the same.

A further embodiment of the present invention will be described next.

Figure 11A:
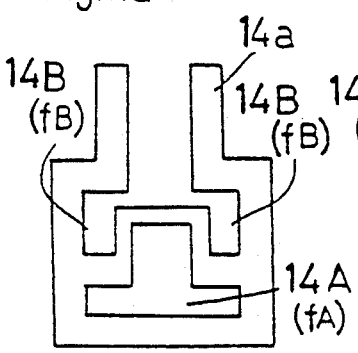
FIGS. 11 through 13 show a still further alternate embodiment of the present invention, with FIGS. 11(*a*), 11(*b*) and 11(*c*) being views of constituting elements, FIG. 12 being a perspective view and FIG. 13 being an enlarged section, respectively.
Figure 11B:
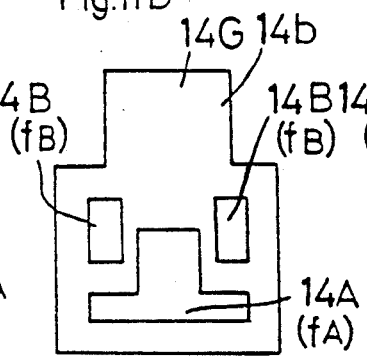
Figure 11C:
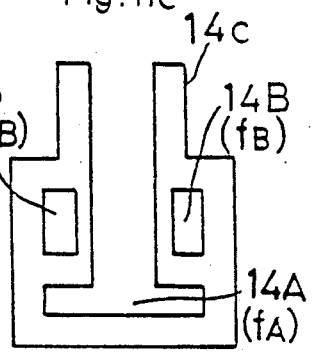
Figure 12:
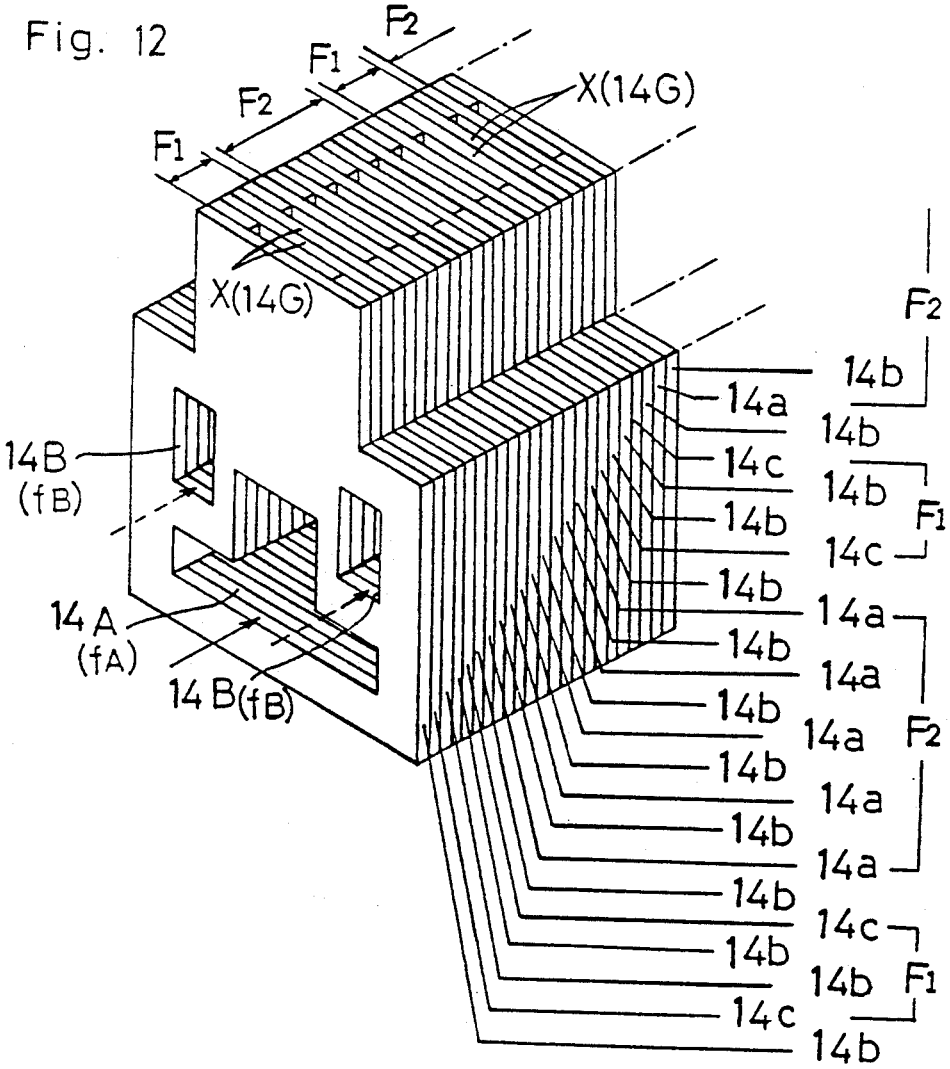
Figure 13:
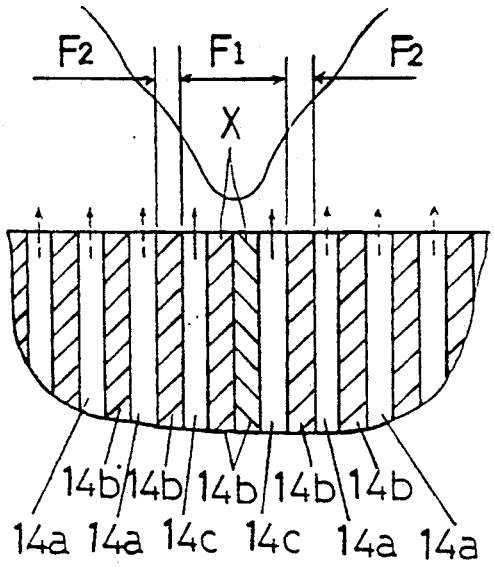

In a gas burner of this embodiment, first through third plate members 14*a*, 14*b* and 14*c* respectively shown in FIGS. 11(*a*), 11(*b*) and 11(*c*) are overlapped on each other as shown in FIGS. 12 and 13 to form a pair of the second flame openings F2 across the first flame opening F1. In this first flame opening F1 also, it is possible to form the flame-retaining portion X by upper end plate portions 14G of a pair of the second plate members 14*b* disposed centrally of the first flame opening F1 in the opening array direction.

Experiments were conducted using the gas burner of the above-described construction, with eliminating the second plate members 14*b* disposed centrally of the first flame opening F1 for forming the flame-retaining portion, another experiment used one second plate member 14*b* and then the last experiment used two second plate members 14*b*. The results of these experiments are shown in Table 1 below:

TABLE 1

| | lower limit of fuel gas concentration in high-concentration gas | upper limit of average air excess ratio between high and low concentration gases |
|---|---|---|
| none | 10% | 1.2 |
| 1 | 8% | 1.5 |
| 2 | 7% | 1.8 |

where; employed fuel gas: pure methane thickness of first through plate members 14*a*, 14*b*, 14*c*: 1 mm As may be apparent from the above experiment data, if the flame-retaining portion X is disposed centrally of the first flame opening F1, it becomes possible to increase the average air excess ratio, and the higher the flame-retaining effect of the flame-retaining portion X is, the higher the upper limit of the average air excess ratio becomes.

Figure 14:
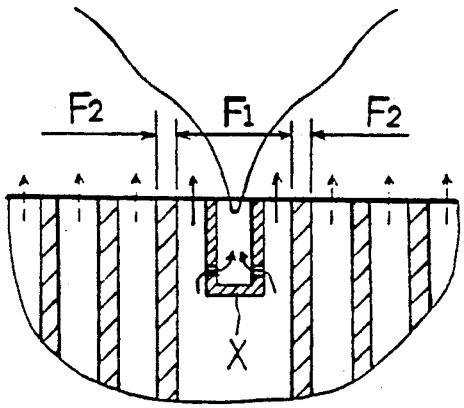
FIG. 14 is an enlarged section of a further embodiment of the invention.

Incidentally, the specific constructions of the first flame opening and of the second flame openings disposed at the sides thereof may be conveniently varied and are not limited to those constructions including the plurality of plate members in the overlapped arrangements. Also, the specific construction and shape of the flame-retaining portion X disposed centrally of the first flame opening may be modified as well. For example, instead of the plate type constructions shown in FIGS. 9, 13 and 16(*b*), the same may be formed as shown in FIG. 14.

Next, referring to FIGS. 17 through 25, further embodiments of the present invention for preventing incomplete combustion at the periphery of the second flame opening F2 will be described next.

Figure 18:
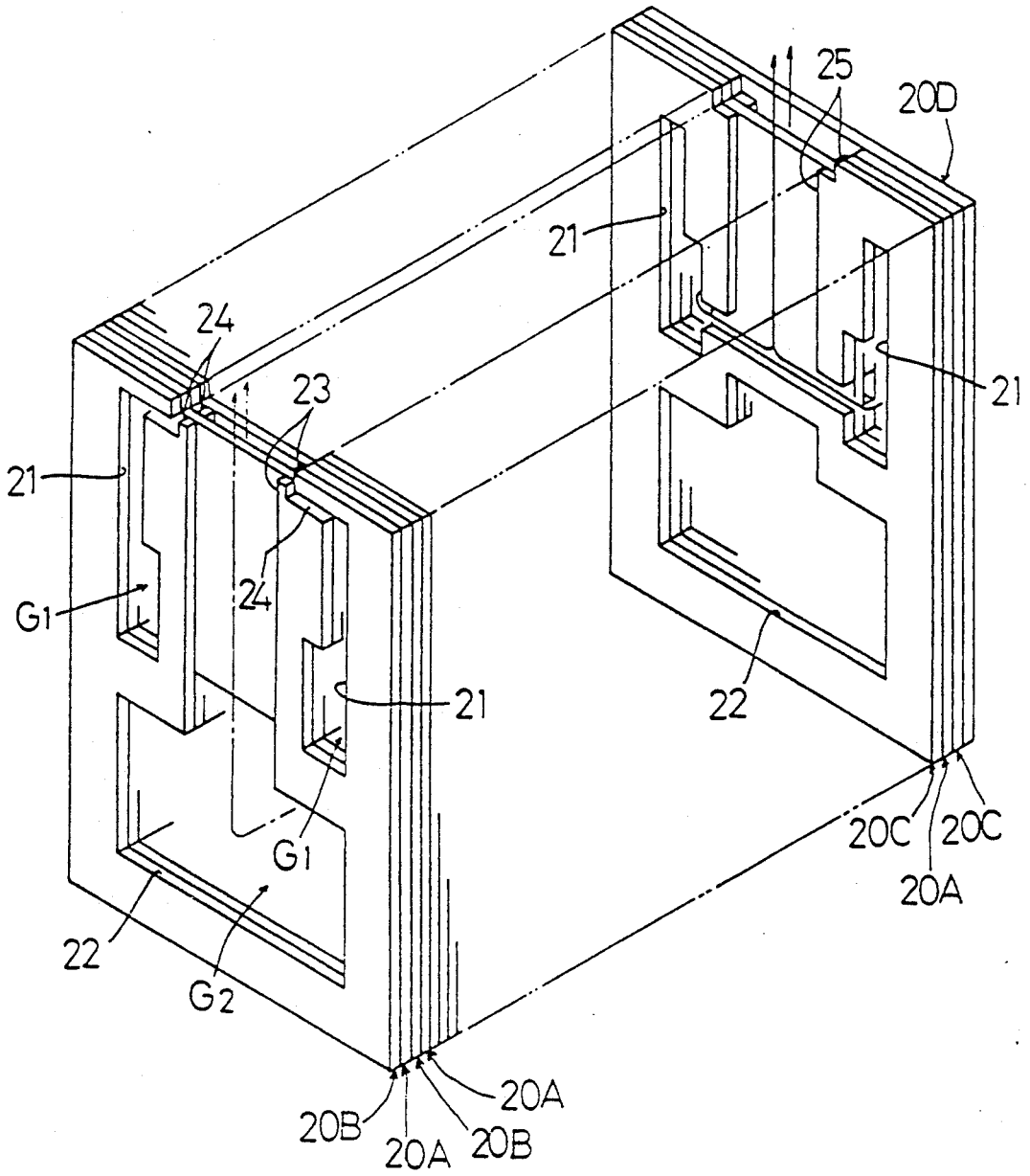
Figure 19:
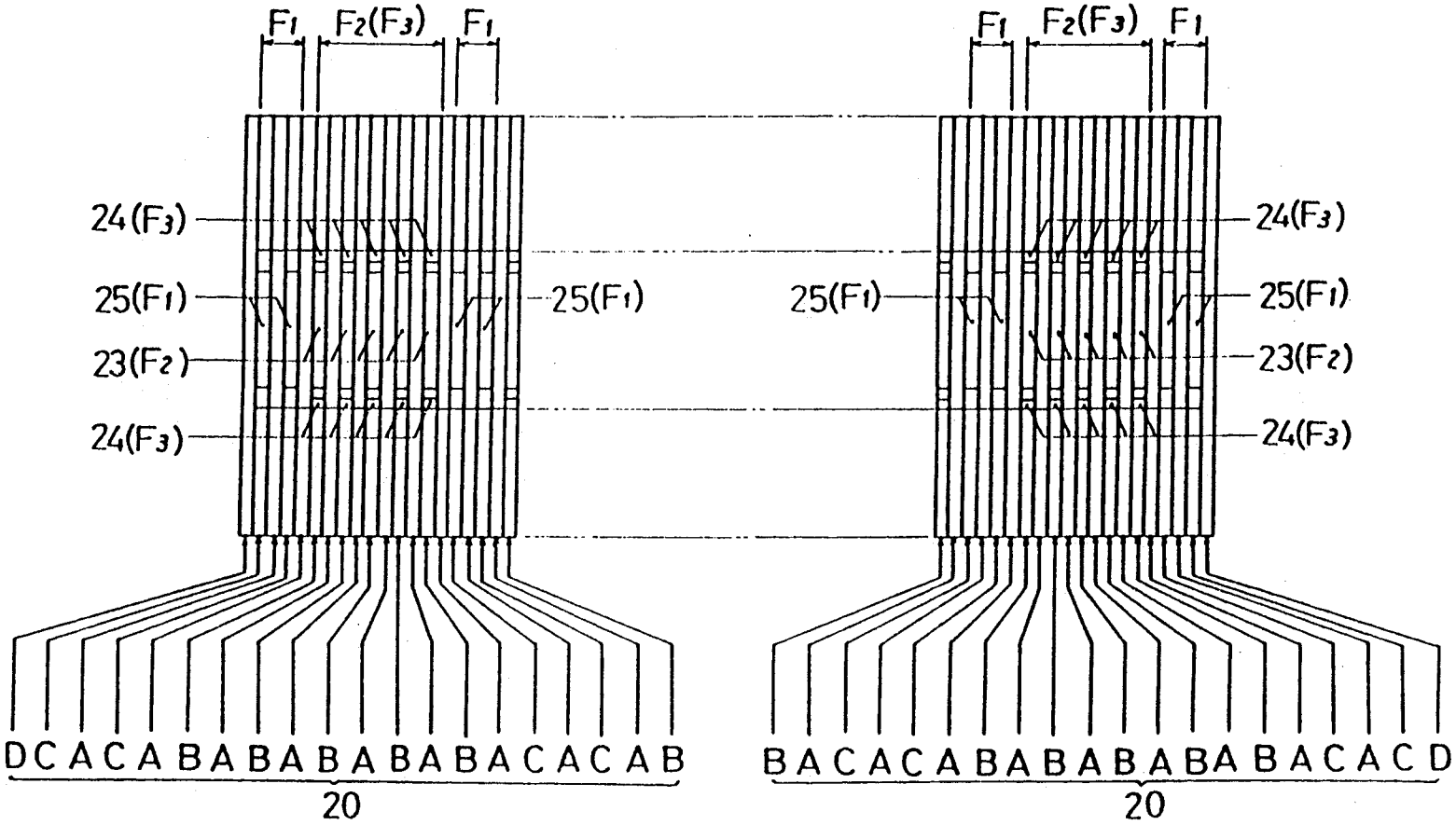

A gas burner of this embodiment includes first through fourth plate members 20A, 20B, 20C and 20D respectively shown in FIGS. 17(*a*), 17(*b*), 17(*c*) and 17(*d*) overlapped with each other as illustrated in FIGS. 18 and 19.

The first through third plate members 20A, 20B and 20C each has a pair of first holes 21 and a second hole 22 for forming, when the plate members are overlapped with each other, a pair of high-concentration gas supply passages G1 and a low-concentration gas passage G2, respectively. The second plate member 20B includes, in addition to the first and second holes 21 and 22, a discharge-opening forming cutout portion 23 opening at the upper edge of the second plate member and communicating with the second hole 22 for forming the low-concentration mixture gas supply passage and further an auxiliary-discharge opening forming cutout portion 24 opening at the upper edge of the plate member adjacent the sides of the cutout portion 23 and communicating respectively with the pair of first holes 21 for forming the high-concentration mixture gas supply passage.

In addition to the first and second holes 21 and 22, the third plate member 20C has a discharge-opening-forming cutout portion 25 opened at an upper end of the plate member and communicating with the pair of first holes 21 for forming the high-concentration gas supply passage.

In overlapping the first through fourth plate members 20A, 20B, 20C and 20D to constitute the gas burner, while the first plate members 20A are positioned at the side ends, the first plate members 20A and the third plate members 20C are alternately overlapped with each other, such that the upper opening ends of the discharge-opening-forming cutout portions 25 of the respective third plate members 20C form the discharge openings of a second flame opening F2 for discharging the low-concentration mixture gas (denoted by an arrow of a dotted line in FIG. 1) supplied from the low-concentration gas supply passage G2 to discharge-opening-forming cutout portions 23 of the respective second plate members 20B.

Further, by alternately overlapping the first plate members 20A and the second plate members 20B with a pair of first plate members 20A being disposed at opposed sides of the second plate member 20B, there is formed the second flame opening F2 having the discharge opening at the upper opening portion of the discharge-opening forming cutout portions 23 of the respective second plate members 20B and discharging the low-concentration mixture gas supplied from the low-concentration mixture gas supply passage G2 to the discharge-opening forming cutout portions 23 of the respective second plate members 20B (the flow is denoted by an arrow of dashed line in the drawings).

Then, the above first flame openings F1 and second flame openings F2 are alternately disposed in an array, with the adjacent flame openings F1 and F2 sharing the same first plate member 20A and with the addjacent pair of opening arrays being separated by the first plate member 20D acting as a partition element. These arrangements together constitute the gas burner of this embodiment.

To the high-concentration gas supply passage G1 and to the low-concentration gas supply passage G2, the mixture gases of fuel gas and combustion air are supplied through holes separately defined in the one plate member 20A. The mixture gas supplied to the high-concentration gas supply passage G1 comprises a high-concentration gas having a predetermined fuel gas concentration within stable and self-combustible range; whereas, the mixture gas supplied to the low-concentration gas supply passage G2 comprises a low-concentration gas having a predetermined fuel gas concentration below the stable and self-combustible range.

That is to say, while the stable self-combustible high concentration gas is supplied to the first flame opening F1 to form a stable flame, the unstable and non-self-combustible low-concentration gas is supplied to the second flame opening F2 adjacent thereto.

In the gas burner body including the first through fourth plate members 20A, 20B, 20C and 20D in the overlapped arrangement, openings of auxiliary-discharge-opening forming cutout portions 24 of the respective second plate members 20B are to form arrays of third discharge opening F3 at the respective right and left sides of the opening arrays. Then, if a portion of the stable self-combustible high-concentration gas fed to the high-concentration gas supply passage G1 is discharged via the auxiliary-discharge-opening forming cutout portions 24 through these third discharge openings F3, the effect of the stable flame formations of the high-concentration gas may favorably affect also the low-concentration gas flame formations at the respective side end second flame openings F2.

Further, in disposing the first flame openings F1 and the second flame openings F2 alternately each other, the first flame openings F1 positioned at the forward and backward ends of the flame opening array are provided as third flame openings. These third flame openings, with the effect of stable flame formations thereof of the high-concentration gas, serve to assist stable flame formations at the second flame openings F2 disposed adjacent thereto.

The above-described embodiments illustrated in FIGS. 17 through 25 may be alternatively embodied as specified as (a) through (d) below:

(a) The auxiliary third flame openings F3 disposed at the right and left sides of the opening arrays may comprise a plurality of flame openings aligned in the direction of the opening arrays, or may be formed as continuous slit type openings extending in the opening array direction. Further varied modifications of these third flame openings F3 will be also obvious for those skilled in the art.

Figure 20:
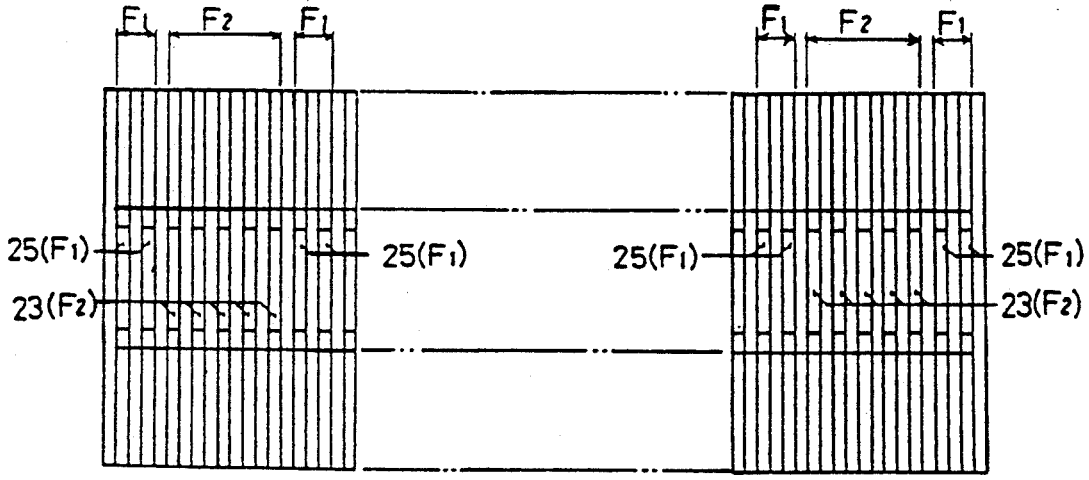

(b) As shown in FIG. 20, while the third flame openings F3 are eliminated, the gas burner includes the first flame openings F1 also at the forward and backward ends of the arrays of alternately disposed first and second flame openings F1 and F2.

Figure 21:
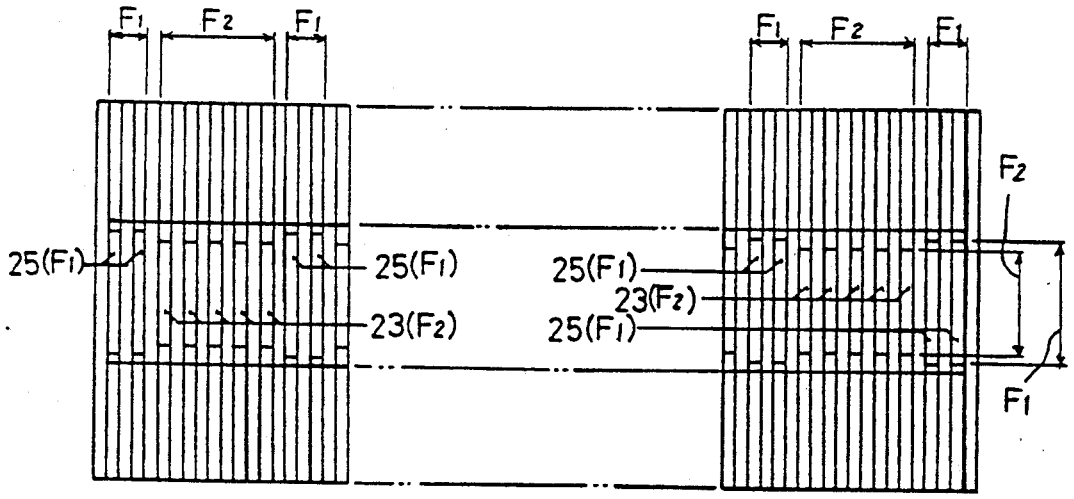

(c) As shown in FIG. 21, the first flame openings F1 may have their sides in the opening width direction thereof exceeding outwardly of the right and left sides of the second flame openings F2 acting as the third flame opening, such that the stabilizing effect of the high-concentration gas flame formations may more sufficiently act on the low-concentration gas discharged from the sides of the second flame openings F2.

Figure 22:
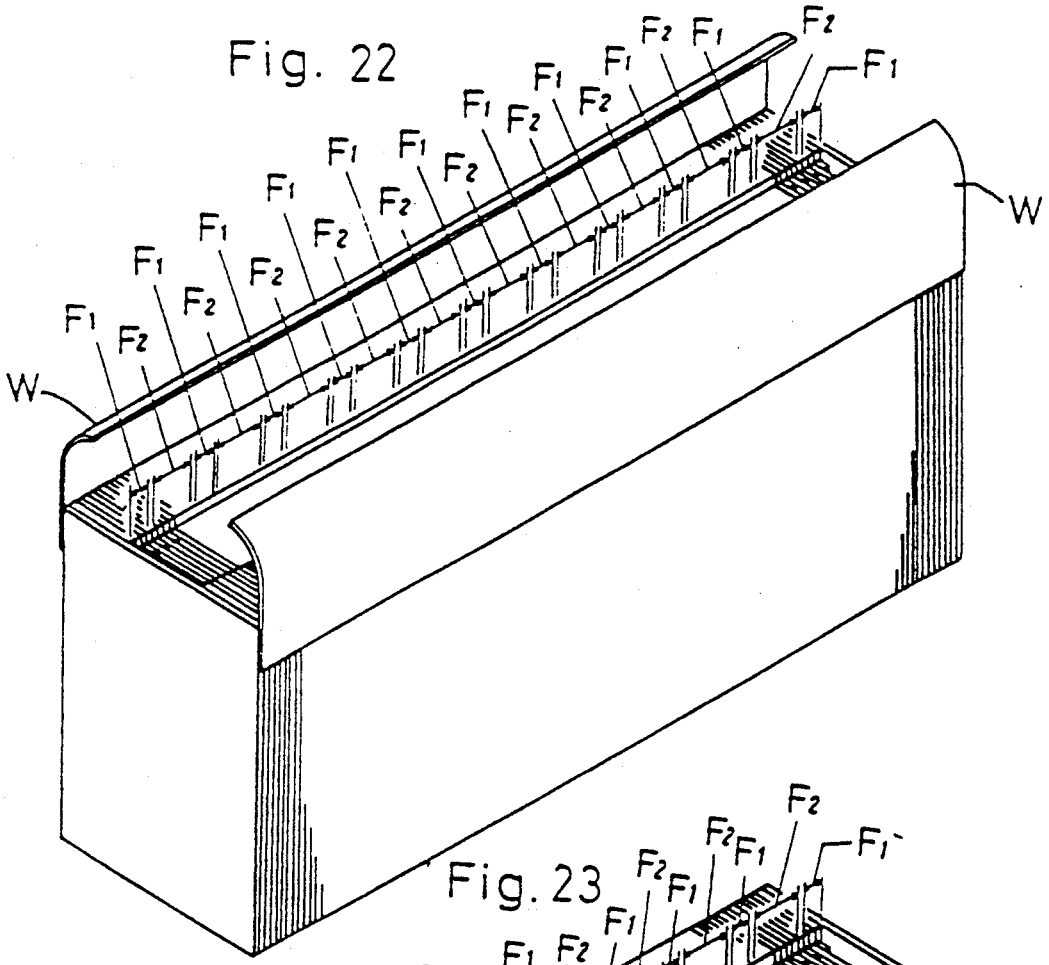

(d) As shown in FIG. 22, as the both sides of the flame openings, there may be provided wall portions W for blocking inflow of external atmosphere to the flame opening surfaces so as to restrict or prevent incomplete combustion of the low-concentration gas discharged from the both sides of the second flame openings F2.

Figure 23:
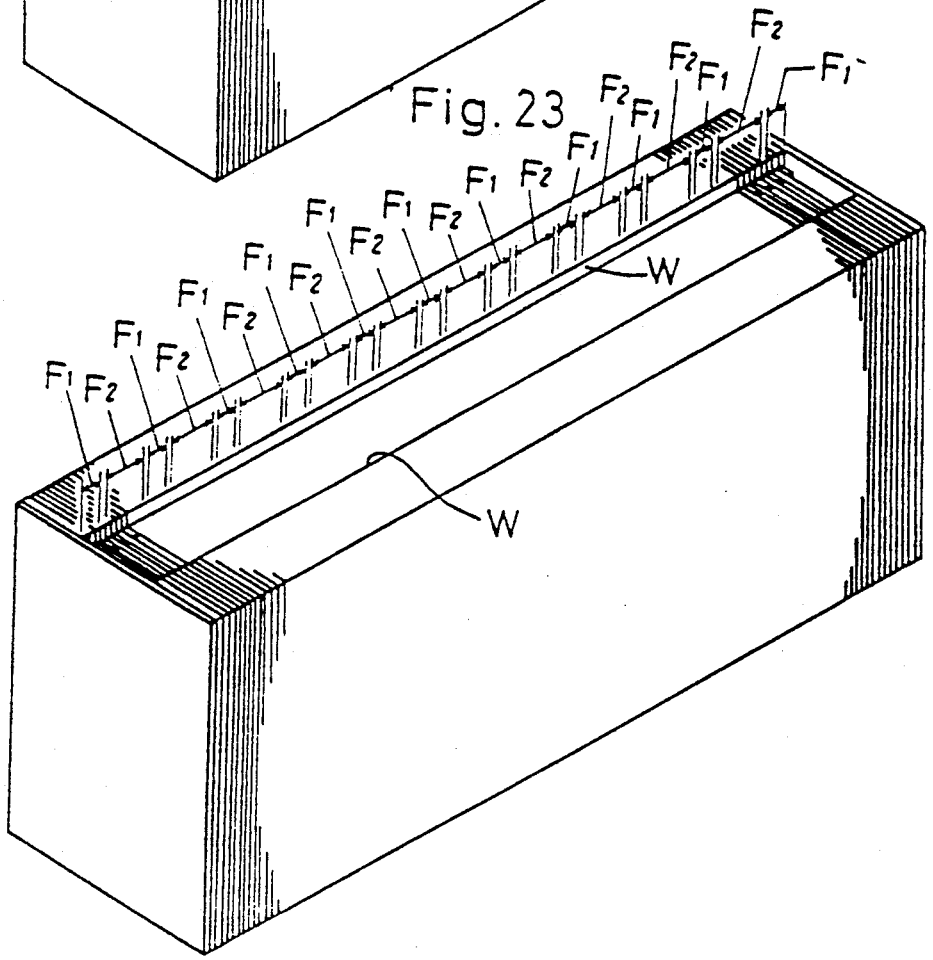
Figure 24:
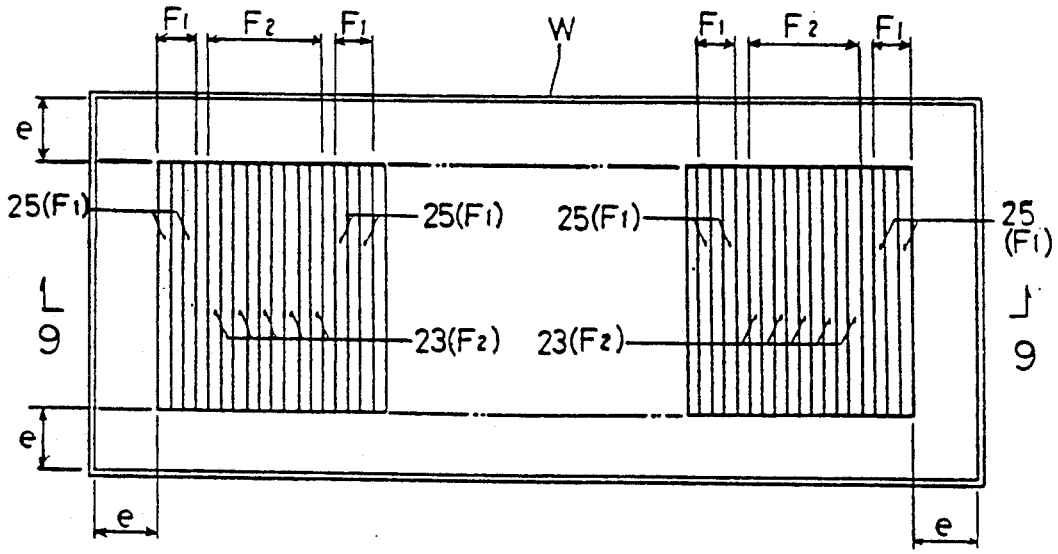
Figure 25:
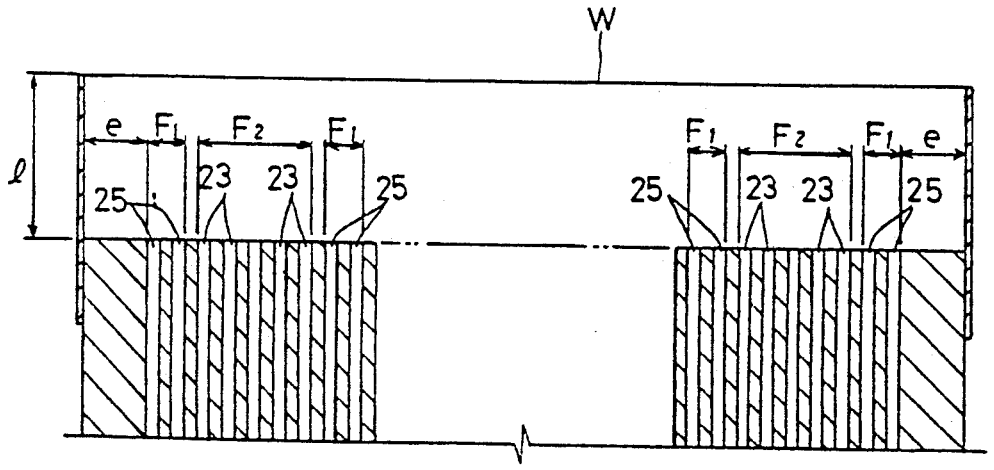

The wall portion W, as shown in FIG. 23 for example, may be formed in such a way as to protect both outerside portions of the flame opening arrays of the burner body, or may be formed as a continuous wall extending over the entire periphery of the flame opening surface as shown in FIGS. 24 and 25. If the latter construction of FIGS. 24 and 25 is to be employed, a dimension denoted by mark (e) in the drawings should preferably range between 5 mm and 20 mm and a further dimension denoted by mark (l) should exceed 30 mm.

The above-described constructions for preventing the incomplete combustion of the low-concentration gas may be employed either alone or in combination. Further, the applications of these constructions are not limited to the gas burner body including a plurality of plate members in an overlapped arrangement but may be applied also to various types of gas burners having different constructions.

Next, referring to FIGS. 26 through 36, there will be described a still further embodiment of the invention in which a plurality of plate members substitute and eliminate the mixers.

Figure 26A:
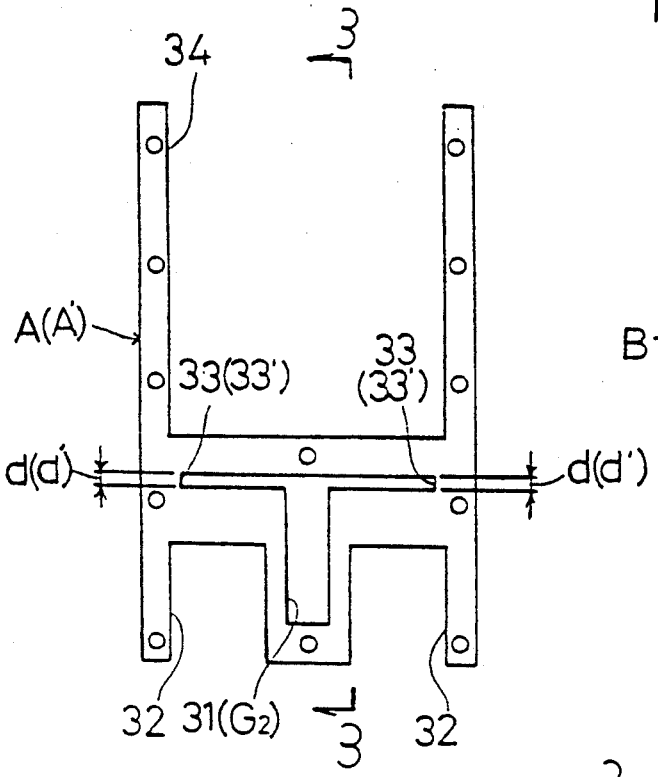
Figure 26B:
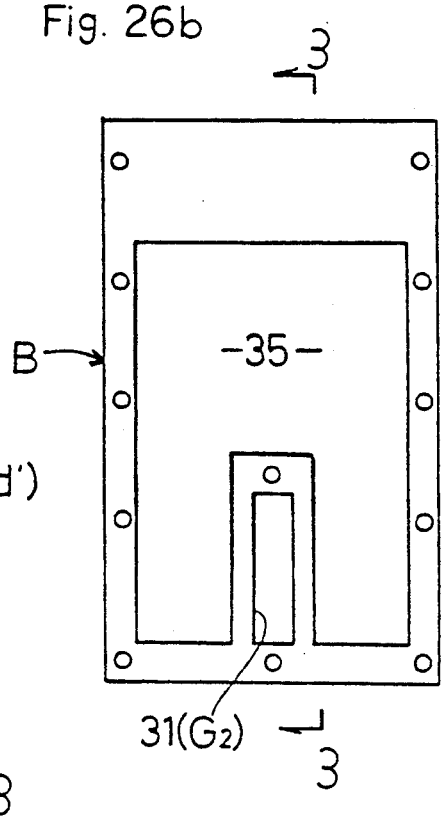
Figure 26C:
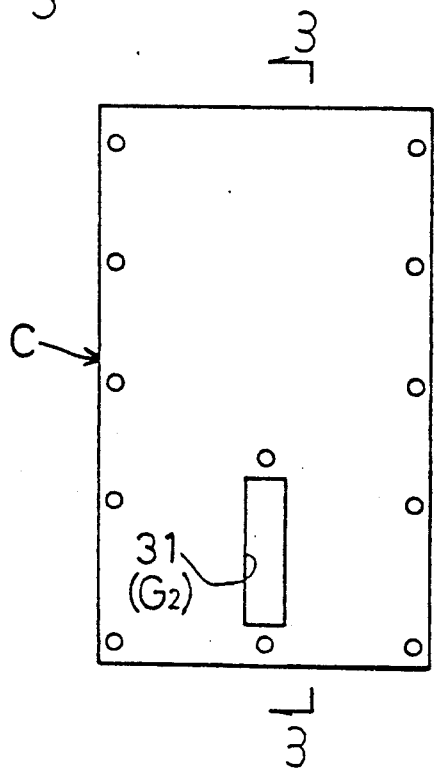
Figure 27:
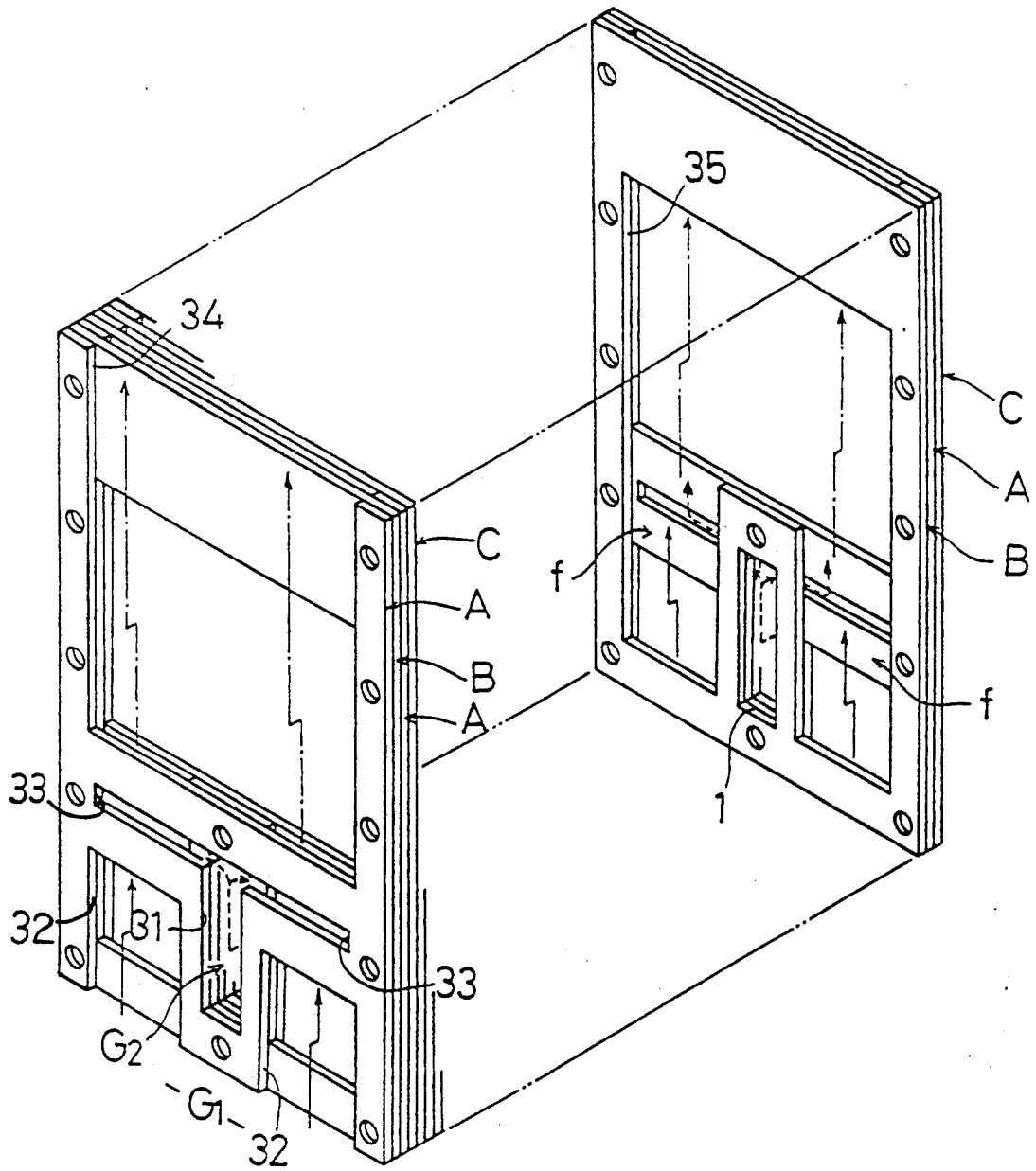
Figure 28:
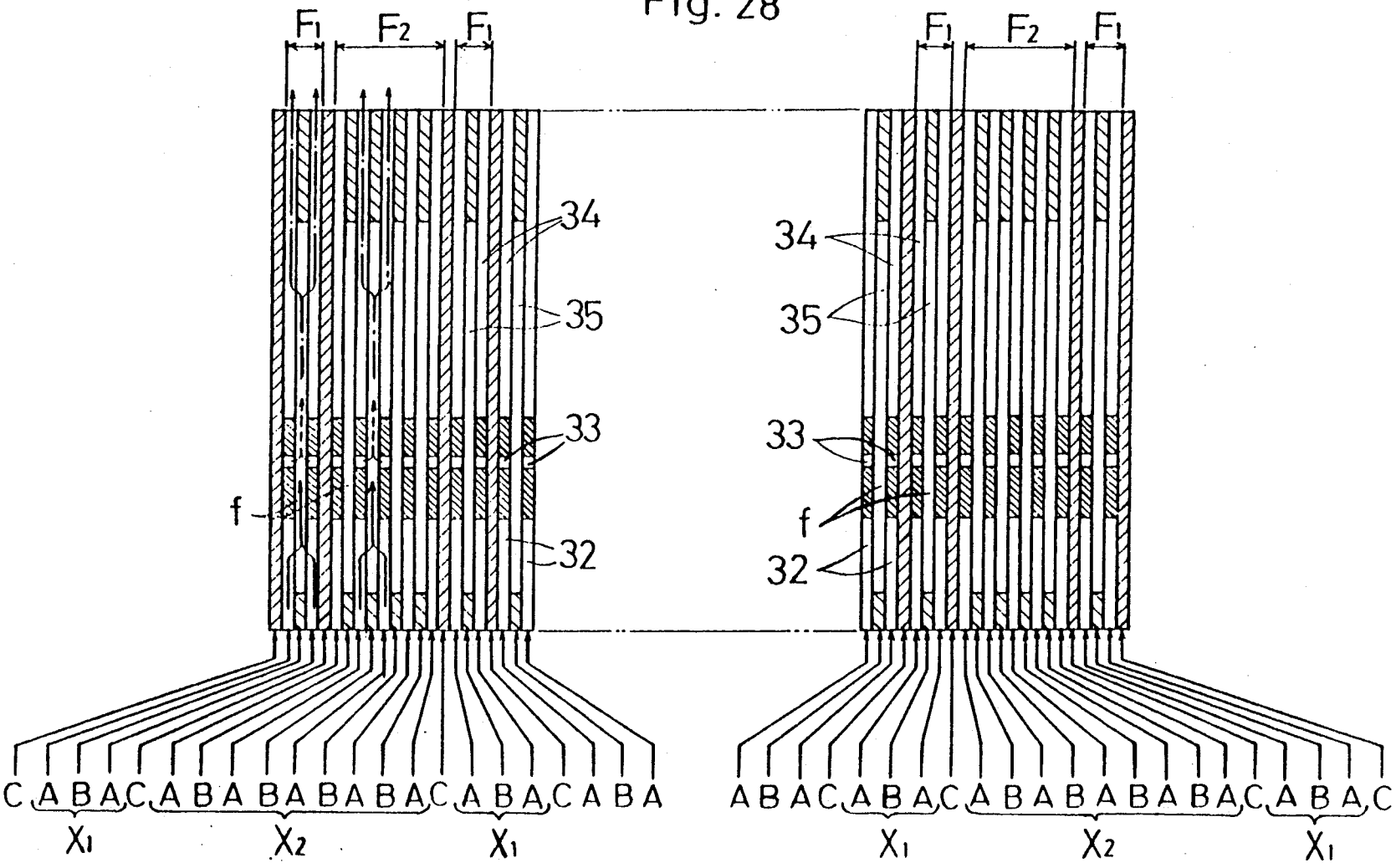

A gas burner of this embodiment includes first through third plate members A, B and C respectively shown in FIGS. 26(*a*), 26(*b*) and 26(*c*) overlapped with each other as illustrated in FIGS. 27 and 28.

Each of the first through third plate members A, B and C has a flow-passage forming hole 31 for forming together with a continuous flow passage G2 when these plate members are overlapped with each other.

Further, each first plate member A has, in addition to the flow-passage forming hole 31, a pair of first openings 32 (specifically, cutouts opening at a lower edge of the plate member) for communicating a first gas supply passage G1 formed by a lower portion of the burner body.

Also, the first plate member includes a pair of second openings 33 (specifically cutouts opening to the flow-passage forming holes 31) for communicating a second gas supply passage 32 formed continuously by the flow-passage forming holes 31 and a discharge-opening forming cutout portion 34 opening at an upper edge of the plate member.

On the other hand, each second plate member B includes, separately of the flow-passage forming hole 31, a communicating-flow-passage forming hole 35 which is to communicate with parts of the first opening 32, second opening 33 and the discharge-opening forming cutout portion 34 of the first plate member A when the second plate member B is overlapped with the first plate member A.

Accordingly, when the first plate members A and the second plate members B are overlapped with each other, the first openings 32 and the discharge-opening forming cutout portions 34 inside the respective first plates A become communicated with each other through the communicating-passage forming holes 35 of the adjacent second plate members B thereby forming a constricted flow passage f. This constricted flow passage f has its flow amount of the first gas supplied from the first openings 32 regulated by the thickness of the second plate members B.

Then, a gas burner body is formed by alternately disposing first and second congregate members X1 and X2 in between a pair of third plate member C acting as partition plates, with the first and second congregate members X1 and X2 including the first and second plate members A and B by a different number ratio. In these first and second congregate members X1 and X2, a mixture gas (the flow is indicated by an arrow of dashed line) of the first gas (the flow is indicated by an arrow of solid line) supplied from the first gas supply passage G1 and of the second gas (the flow is indicated by an arrow of broken line) supplied from the second gas supply passage G2 is discharged through the cutout portions 34. The groups of the cutout portions 34 each in the first and second congregate members X1 and X2 constitute the first and second flame openings F1 and F2, respectively.

Mixture ratios of the mixture gases discharged through thus-constructed first and second flame openings F1 and F2 (i.e. the mixture ratios between the first gas and the second gas) differ from each other due to the difference in the numbers of the first plate members A and the second plate members B used in forming the first and second congregate members X1 and X2. More particularly, the first congregate member X1 includes the first plate members A and the second plate member B in the pattern order of A-B-A by the number ratio of 2:1, whereby the number of constructed flow passages f for regulating the flow amount of the first gas relative to the number of the second openings 33 for mixing and feeding the second gas into the first gas is set at 1:2. On the other hand, the second congregate member X2 includes the first plate members A and the second plate members B in the pattern order of A-B-A-B-A-B-A-B-A by the number ratio of 5:4, whereby the number of the constricted flow passage f relative to the number of the second openings 33 is set at 4:5. Accordingly, since the numbers of the constricted flow passages f and of the second openings 33 differ from each other between the first congregate member X1 and the second congregate member X2, it becomes possible to differ the mixture ratios of the mixture gases discharged through the first flame opening F1 and through the second flame opening F2, respectively. Consequently, it becomes possible to vary the discharge gas mixture ratios between the first flame opening F1 and the second flame opening F2 adjacent thereto.

The patterns of the combinations between the first gas and the second gas may be any of those listed in Table 2 below. Then, in an actual operation of the gas burner, as the gas mixture ratios of the first flame opening F1 and the second flame opening F2 differ from each other as described above, either of the first and second flame openings F1 and F2 discharges a mixture gas with a high fuel gas concentration while the other discharges a further mixture gas with a low fuel gas concentration.

TABLE 2

| | 1st gas | 2nd gas |
|---|---|---|
| pattern 1 | fuel gas | combustion air |
| pattern 2 | combustion air | fuel gas |
| pattern 3. | fuel gas | mixture gas |
| pattern 4 | mixture gas | fuel gas |
| pattern 5 | combustion air | mixture gas |
| pattern 6 | mixture gas | combustion air |

A further embodiment of the present invention will be described next.

Figure 29:
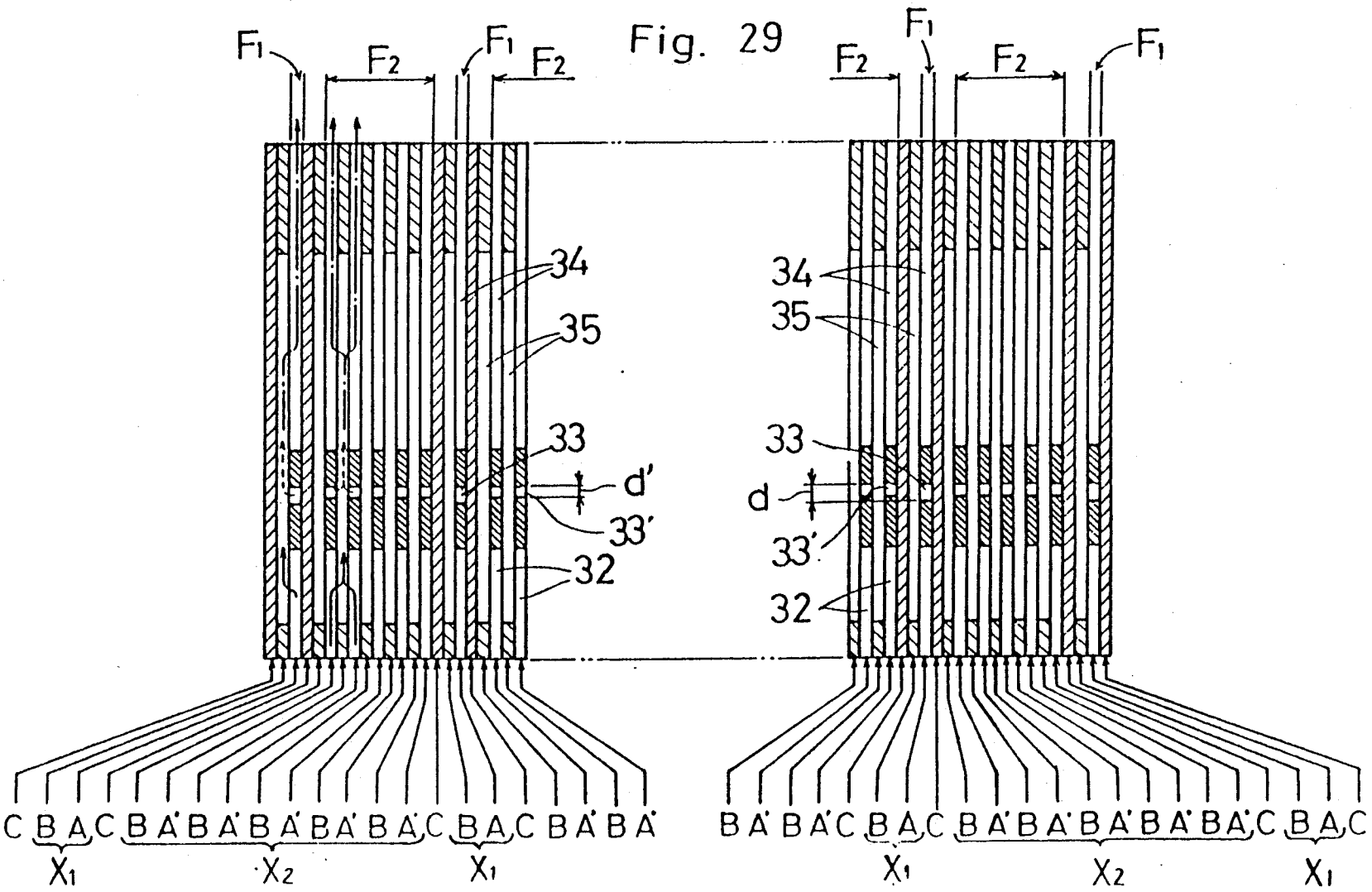
FIG. 29 shows a still further embodiment of the present invention and is a section taken along a line III—III in FIG. 28, FIGS. 30 through 32 show a further embodiment of the present invention, with FIGS. 30(*a*), 30(*b*) and 30(*c*) showing constituting elements, FIG. 31 being a partially cutaway perspective view and FIG. 32 being a section taken along a line VII—VII in FIG. 30, respectively.

A gas burner of this embodiment includes the first through fourth plate members A, B, C and A′ respectively shown in FIGS. 26(*a*), 26(*b*) and 26(*c*) overlapped with each other as illustrated in FIG. 29.

This embodiment differs from the previous embodiment shown in FIG. 28 in two respects. That is, first, in this embodiment, the fourth plate member A′ is used instead of the first plate member A employed in forming the second congregate member X2. Second, the first plate members A or the fourth plate members A′ and the second plate members B are overlapped in either of the first and second congregate members X1 and X2 by the same number ratio of 1:1. That is to say, the second opening 33 of the first plate member A used in the first congregate member X1 and the second opening 33′ of the fourth plate member A′ used in the second congregate member X2 has different opening widths d and d′ such that overlapping areas thereof relative to the communicating-passage forming hole 35 of the second plate member B may differ from each other. Accordingly, the ratios of the mixture gases respectively discharged through the first and second flame openings F1 and F2 also differ from each other due to the difference between the opening width d and the opening width d′.

In this embodiment also, the patterns of the combinations between the first gas and the second gas may be any one of those listed in the foregoing Table 2. Accordingly, in an actual gas burner operation, either of the first flame opening F1 and the second flame opening F2 discharges the high-concentration gas while the other discharges the low-concentration gas.

A still further embodiment of the present invention will be described next.

Figure 30A:
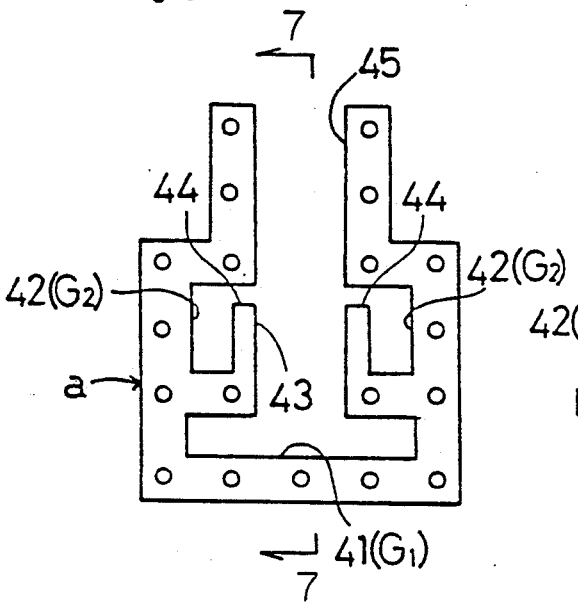
Figure 30B:
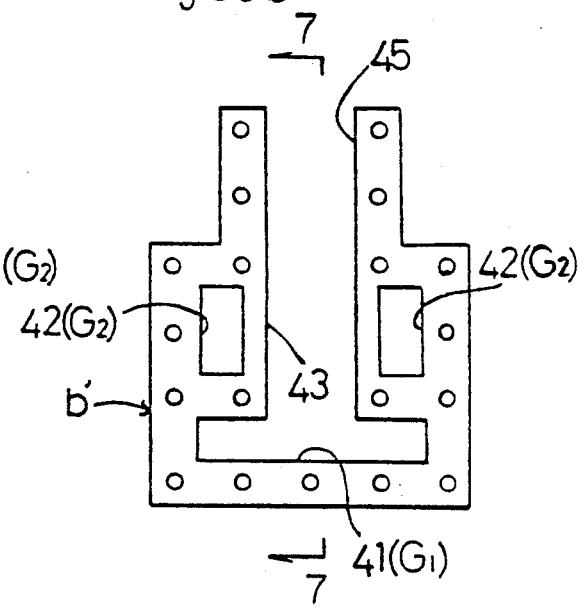
Figure 30C:
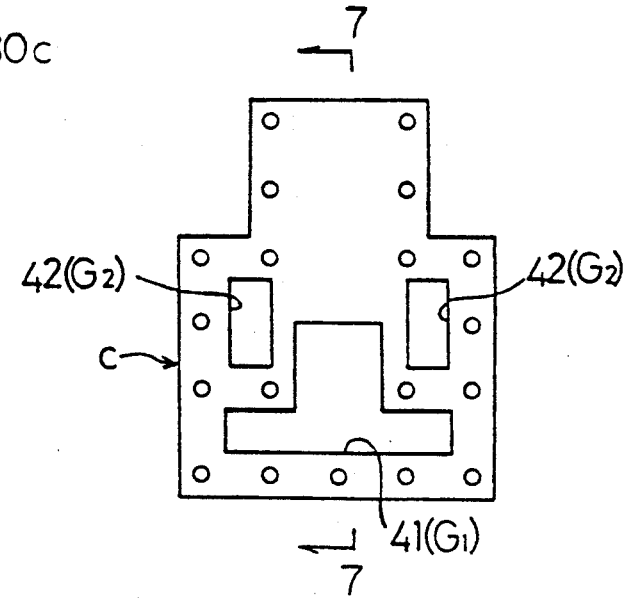
Figure 31:
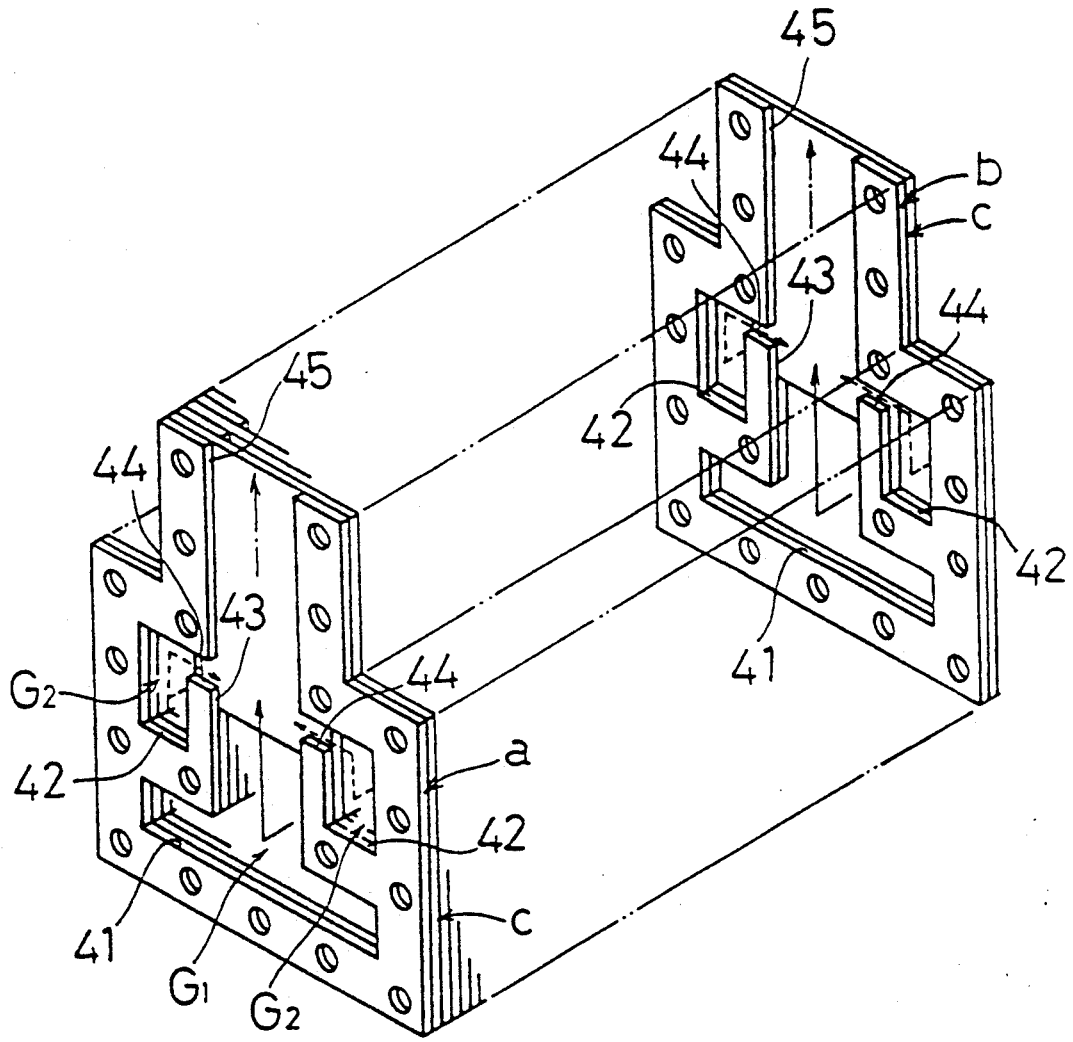
Figure 32:
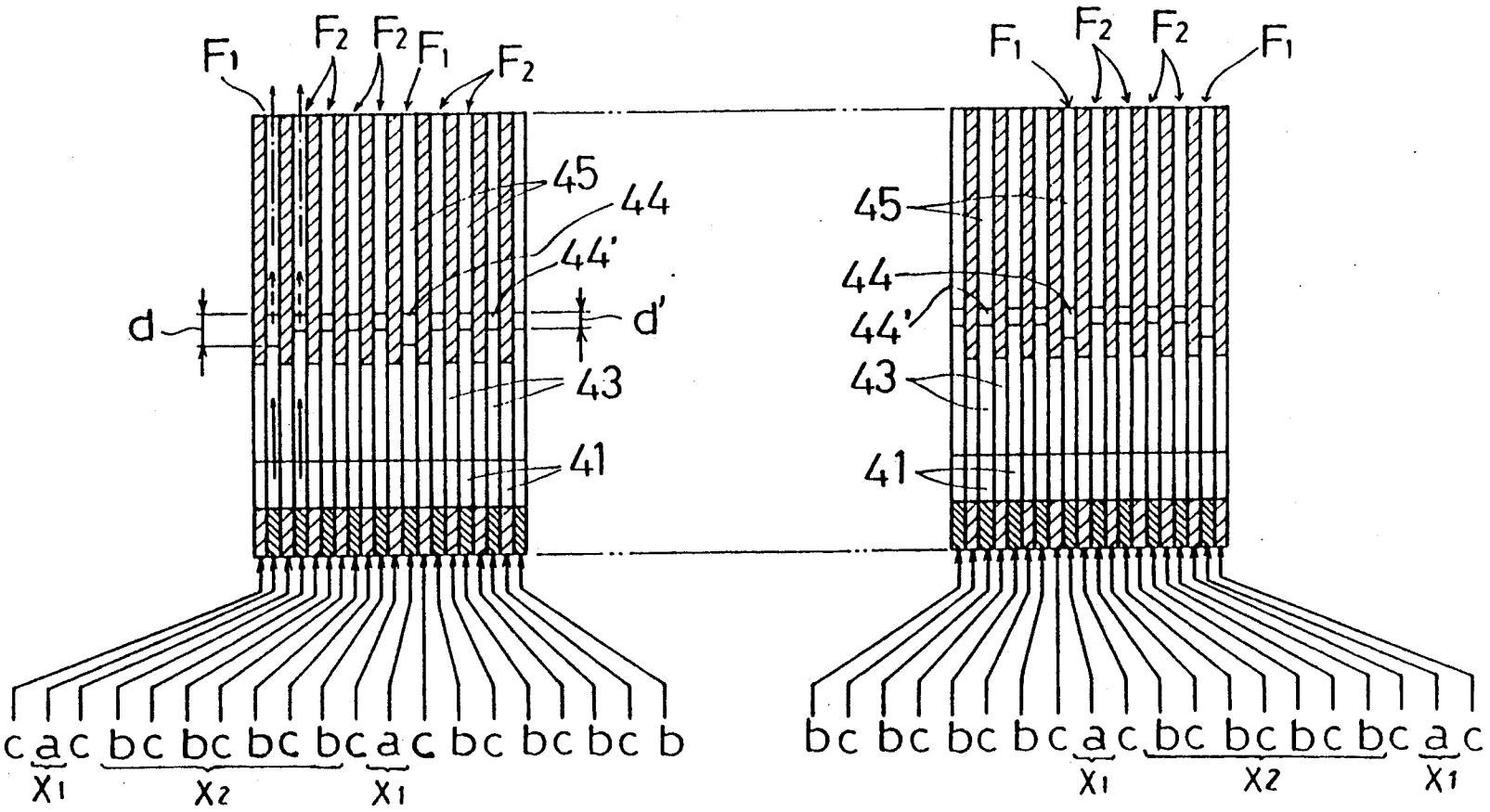
Figure 33A:
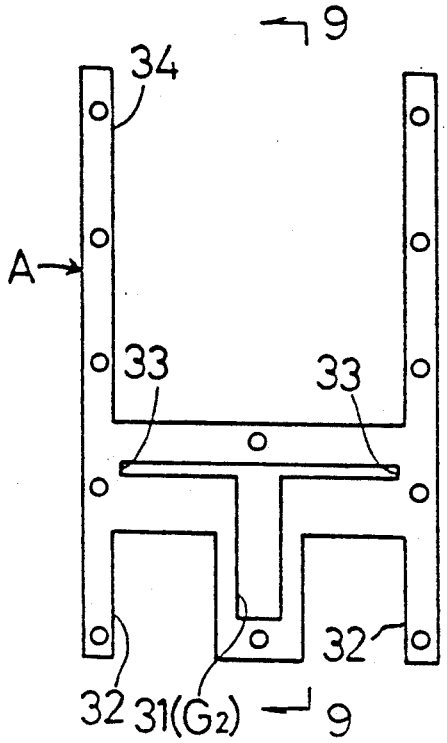
FIGS. 33 and 34 show a still further embodiment of the present invention, with FIGS. 33(*a*), 33(*b*), 33(*c*) and 33(*d*) showing constituting elements, and FIG. 34 being a section taken along a line IX—IX in FIG. 33, respectively.
Figure 33B:
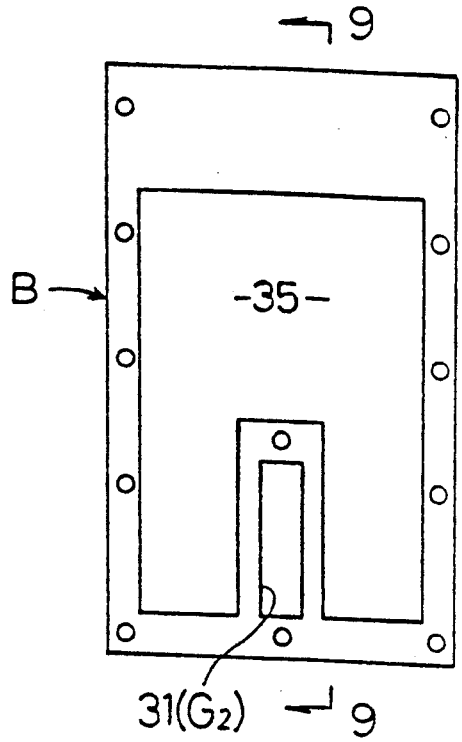
Figure 33C:
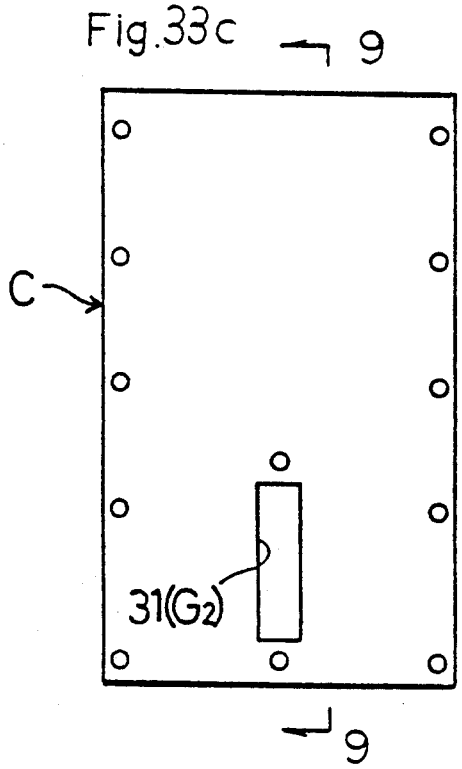
Figure 33D:
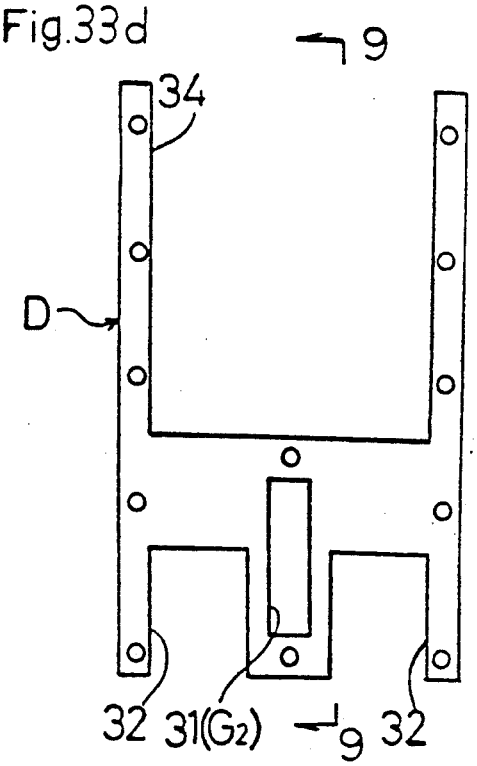

A gas burner of this embodiment includes sixth through eighth plate members a, b and c respectively shown in FIGS. 30(*a*), 30(*b*) and 30(*c*) overlapped with each other as illustrated in FIGS. 31 and 32.

Each of the sixth through eighth plate members a, b and c includes a first-passage forming hole 41 and a second-passage forming hole 42 for forming two types of continuous flow passages G1 and G2 when the plates are overlapped with each other. Further, each of the sixth and seventh plate members a and b includes a second opening 44, 44' communicating with the second flow passage G2 formed by the second-passage forming holes 42 and a discharge-opening forming cutout portion 45 opening at an upper edge of the plate member and communicating with the first opening 43 and the second opening 44, 44'.

That is to say, in this embodiment, the first opening 43 and the second opening 44, 44' are formed as slits for communicating the first-passage forming holes 41 and the second-passage forming holes 42 respectively with the discharge-opening forming cutout portions 45.

Further, the second opening 44 of the sixth plate member a and the seventh opening 44' of the second plate member b differ from each other in its opening width (i.e. slit width), such that the opening width ratios between the first opening 43 and the second opening 44, 44' relative to the discharge-opening forming cutout portion 45 differ from each other between the sixth plate member a and the seventh plate member b.

In forming the burner body by overlapping the sixth through eighth plate members a, b and c, either the sixth plate member a or the seventh plate member b is bound between a pair of the eighth plate member c acting as a partition plate element, whereby there are formed the first flame opening F1 and the second flame opening F2 for discharging the mixture gas of the first gas fed from the first gas supply passage G1 via the first opening 43 (the flow is indicated by an arrow of solid line in the drawings) and the second gas fed from the second gas supply passage G2 via the second opening 44 (the flow is indicated by an arrow of broken line in the drawings).

Then, as the second congregate members X2 including the seventh plate members b and the eighth plate members in the alternate overlapped arrangement and the sixth plate members a are alternately overlapped with each other across the eighth plate member c acting as a partition plate element, there are aligned in an appropriate order the first and second flame openings F1 and F2 having different gas mixture ratios of the first gas and the second gas. Instead of the above arrangement where the sixth plate members a are used without being combined with other plate members, it is also possible to use the first congregate members X1 including the sixth plate members a and the eighth plate members c in the alternate overlapped arrangement.

Incidentally, in this embodiment, a plurality of the second flame openings F2 are disposed in series between adjacent pairs of the first flame openings F1. This continuous arrays of the second flame openings F2 act as flame openings adjacent the first flame openings F1, while the eighth plate members c in the continous arrays of the second flame openings F2 act also as rectifying plates.

In this embodiment also, the patterns of the combinations between the first gas and the second gas may be any one of those listed in the foregoing Table 2. Accordingly, in an actual gas burner operation, either of the first flame opening F1 and the second flame opening F2 discharges the high-concentration gas while the other discharges the low-concentration gas.

A still further embodiment of the present invention will be described next.

Figure 34:
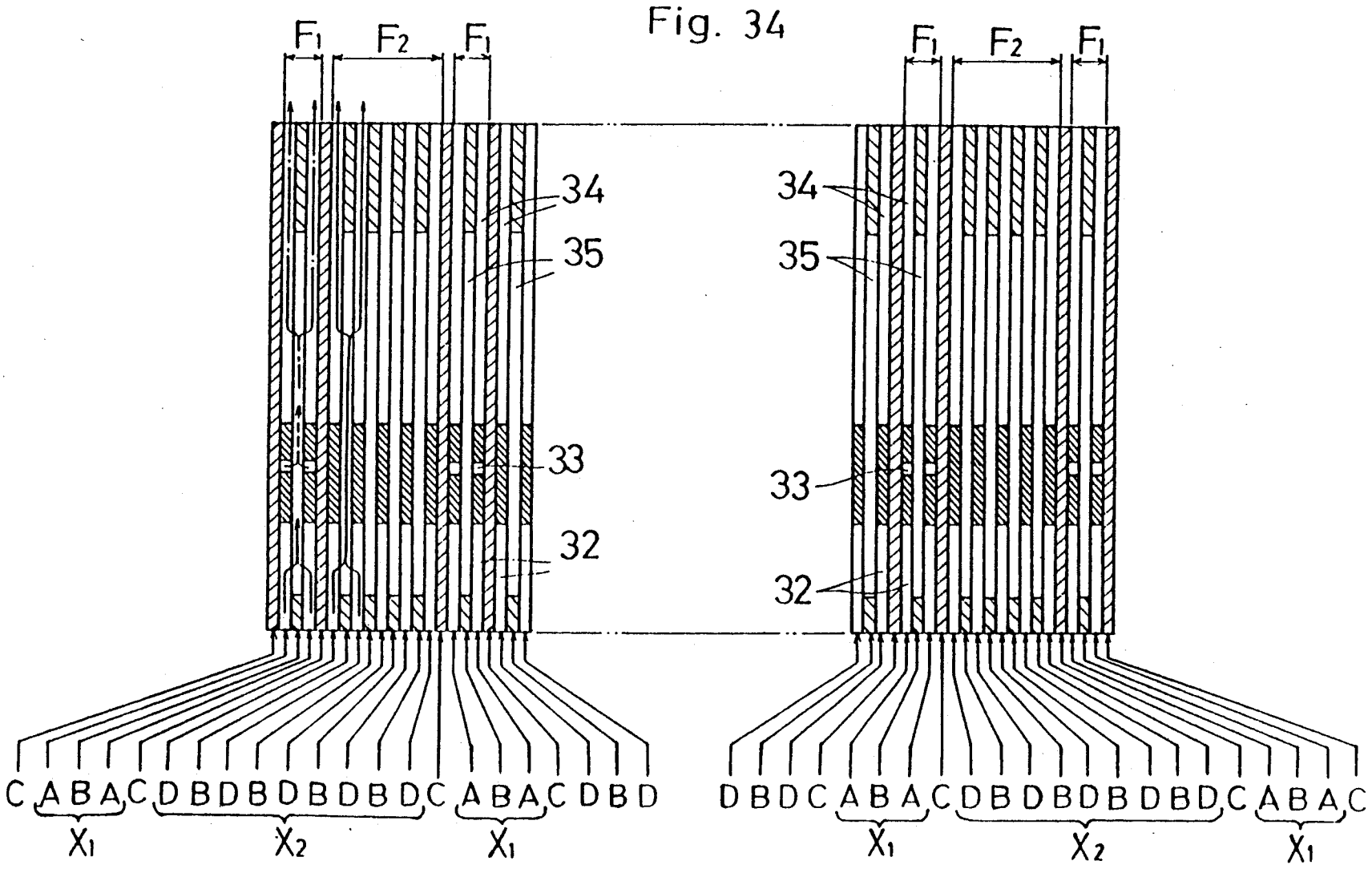

A gas burner of this embodiment includes first through third and fifth plate members A, B, C and D respectively shown in FIGS. 33(*a*), 33(*b*), 33(*c*) and 33(*d*) overlapped with each other as illustrated in FIG. 34.

The first through third plate members A, B and C are of the same constructions as those plate members a, b and c shown in FIGS. 26(*a*), 26(*b*) and 26(*c*); whereas, the fifth plate member D is same as the first plate member A except that the second opening 33 is eliminated in the former.

In forming the gas burner by overlapping the above-described first through third and fifth plate members A, B, C and D, a first congregate member X1 using the first plate members A and the second plate members B is bound between a pair of third plate members C acting as partition plate elements, such that there is formed a first flame opening F1 for discharging, through the opening portion formed by the discharge-opening forming cutout portion 34 of the first plate member A, the mixture gas of the first gas fed from the first gas supply passage G1 via the first opening 32 (the flow is indicated by an arrow of solid line in the drawings) and the second gas fed from the second gas supply passage G2 via the second opening 33 and the communicating-passage forming hole 35 (the flow is indicated by an arrow of broken line in the drawings).

Further, a second congregate member X2 using the fifth plate members D and the second plate members B is bound between a pair of third plate members C acting as partition plate elements, such that there is formed a second flame opening F2 for discharging, through the opening portion formed by the discharge-opening forming cutout portion 34 of the fifth plate member D, only the first gas fed from the first gas supply passage G1 via the first opening 32 and the communicating-passage forming holes 35 (the flow is indicated by an arrow of solid line in the drawings).

Then, if an assembly constituted by one first congregate member X1 bound betweed a pair of third plate members c and a further assembly constituted by one second congretate member X2 bound between a pair of third plate members c are continously aligned, there may be alternately formed the first flame openings F1 and the second flame openings F2 having different mixture ratios of the first and second gases.

The patterns of the combinations between the first gas and the second gas may be any one of those listed in Table 3 below. Accordingly, in an actual gas burner operation, either of the first flame opening F1 and the second flame opening F2 discharges the high-concentration gas while the other discharges the low-concentration gas.

TABLE 3

| | 1st gas | 2nd gas |
|---|---|---|
| pattern 7 | mixture gas | fuel gas |
| pattern 8 | mixture gas | combustion air |

A still further embodiment of the present invention will be described next.

Figure 35A:
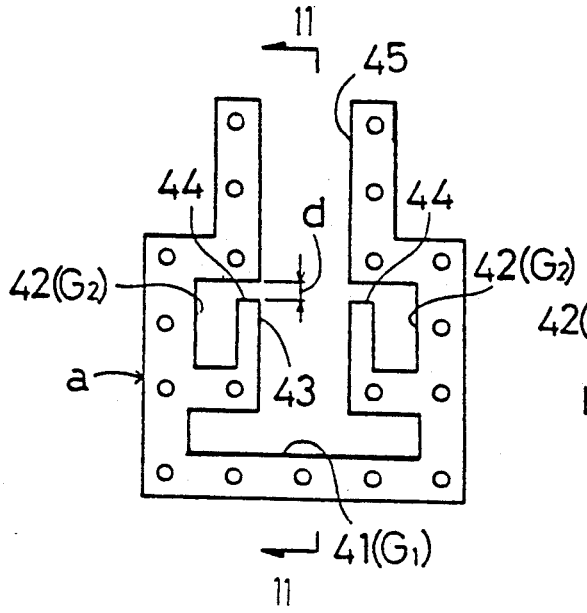
FIGS. 35 and 36 show a further embodiment of the invention, with FIGS. 35(*a*), 35(*b*) and 35(*c*) showing constituting elements and FIG. 36 being a section taken along a line XI—XI in FIG. 35, respectively.
Figure 35B:
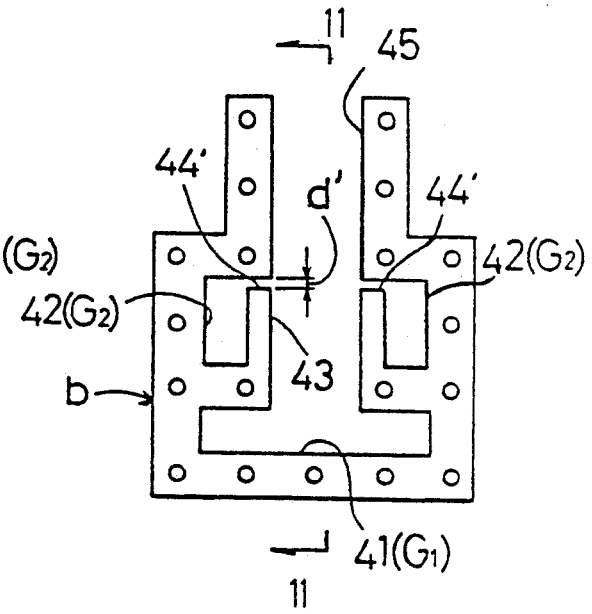
Figure 35C:
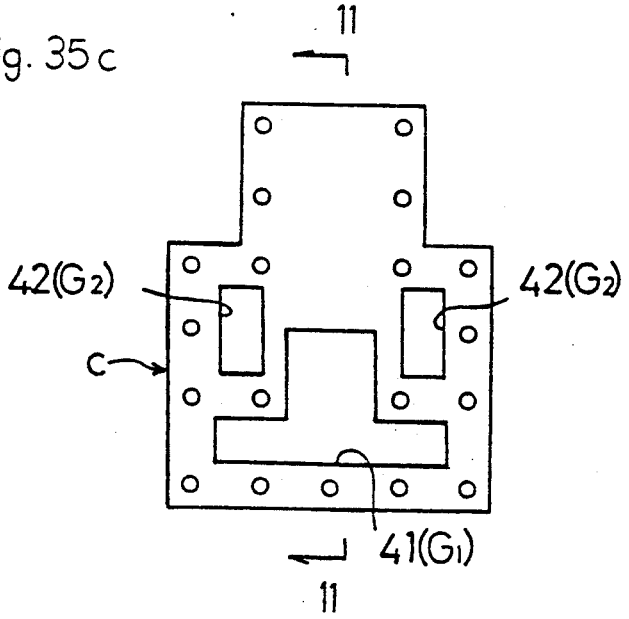
Figure 36:
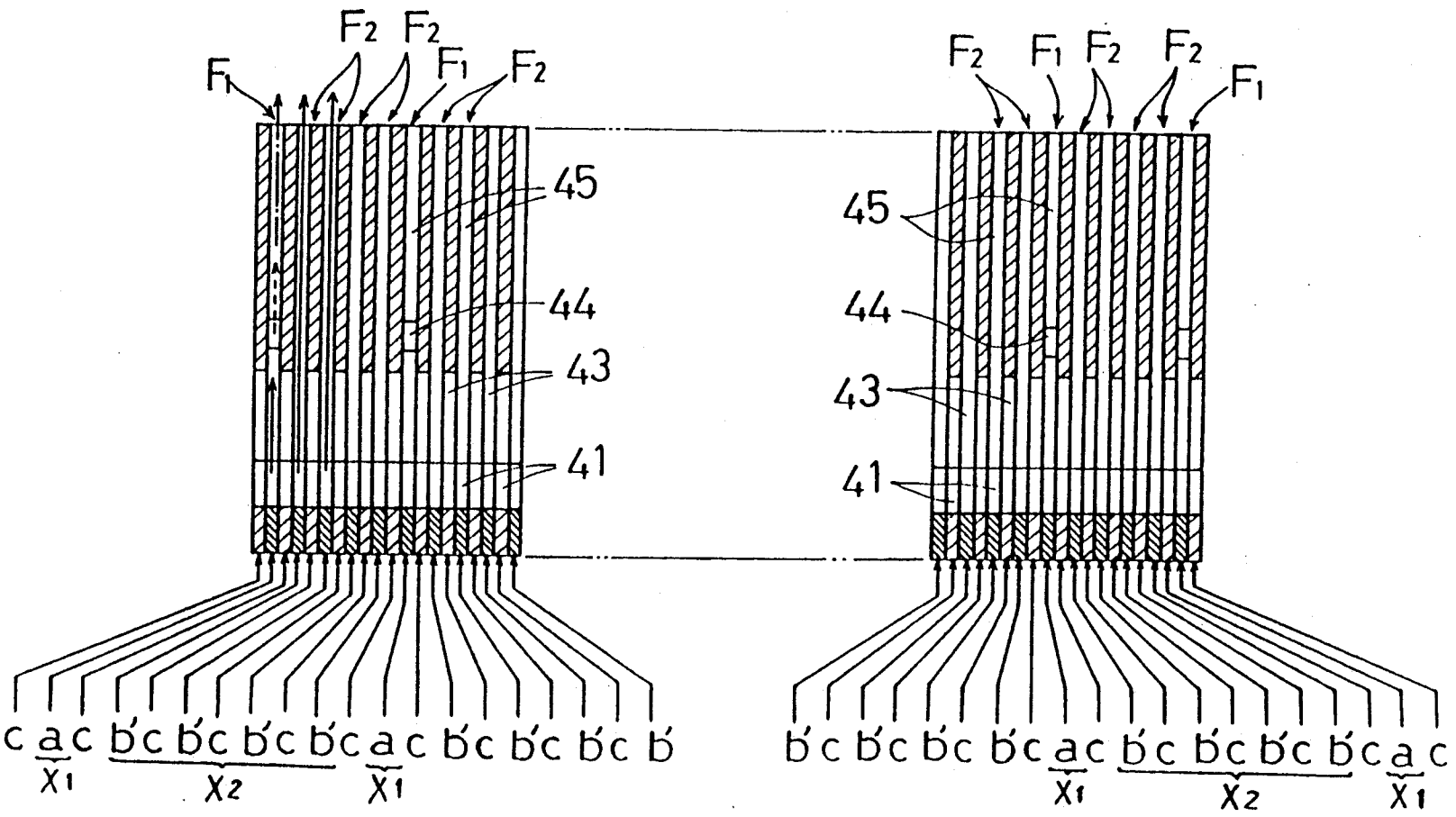

A gas burner of this embodiment includes the sixth, ninth and eight plate members a, b' and c respectively shown in FIGS. 35(*a*), and 35(*b*) and 35(*c*) overlapped with each other as illustrated in FIG. 36.

The sixth and eight plate members a and c are the same as those illustrated in FIGS. 30(*a*) and 30(*b*); whereas the second plate member b' is same as the sixth plate member a except that the second opening 44 (i.e. the slit for communicating between the discharging-opening forming cutout portion 45 and the second-passage forming hole 42) is eliminated in the former.

In forming the gas burner by overlapping the above-described sixth, ninth and eight plate members a, b' and c, the sixth plate member a is bound between a pair of eighth plate members c acting as partition plate elements, such that there is formed a first flame opening F1 for discharging, through the opening portion formed by the discharge-opening forming cutout portion 45 of the sixth plate member a, the mixture gas of the first gas fed from the first gas supply passage G1 via the first opening 43 (the flow is indicated by an arrow of solid line in the drawings) and the second gas fed from the second gas supply passage G2 via the second opening 44 (the flow is indicated by an arrow of broken line in the drawings).

Further, the ninth plate member b' is bound between a pair of third plate members C acting as partition plate elements, such that there is formed a second flame opening F2 for discharging, through the opening portion formed by the discharge-opening forming cutout portion 45 of the second plate member b', only the first gas fed from the first gas supply passage G1 via the first opening 43 (the flow is indicated by an arrow of solid line in the drawings).

Then, as the second congregate members X2 including the ninth plate members b' and the eight plate members c in the alternate overlapped arrangement and the sixth plate members are alternately overlapped with each other across the eight plate member c acting as a partition plate element, there are aligned in an appropriate order the first and second flame openings F1 and F2. Instead of the above arrangement where the sixth plate members a are used without being combined with other plate members, it is also possible to use the first congregate members X1 including the sixth plate members a and the eighth plate members c in the alternate overlapped arrangement.

Incidentally, in this embodiment, a plurality of the second flame openings F2 are disposed in series between adjacent pairs of the first flame openings F1. These continuous arrays of the second flame openings F2 act as flame openings adjacent the first flame openings F1, while the eighth plate members c in the continuous arrays of the second flame openings F2 act also as rectifying plates.

The patterns of the combinations between the first gas and the second gas may be any one of those listed in the foregoing Table 3 as in the case with the previously described embodiments of FIGS. 33 and 34. Accordingly, in an actual gas burner operation, either of the first flame opening F1 and the second flame opening F2 discharges the high-concentration gas while the other discharges the low-concentration gas.

In the above embodiments illustrated in FIGS. 26 through 36, various modifications are possible as specified as (a) through (c) below:

(a) The first gas supply passage G1 and the second gas supply passage G2 may be formed respectively as a continuous flow passage formed inside the burner body by the holes of the respective plate members, or may be formed externally of the burner body as the first gas supply passage G1 described in the embodiments shown in FIGS. 26 and 33. That is, the specific constructions or formations of these passages may be conveniently varied.

(b) The first opening 32 or 43 communicating with the first gas supply passage G1 and the second opening 33 or 44 communicating with the second gas supply passage G2 may be formed as cutouts opening at the outer peripheral edge of the plate member depending on the configuration of the first gas supply passage G1 and that of the second gas supply passage G2. Or, the same may be formed as cutouts or slits opening to the holes of the plate members. Further and other modifications are possible with these openings.

(c) The order of arrangement between the first flame openings and the second flame openings, or the opening widths of the same may be conveniently varied. As one example suitable for combustion, it is conceivable to dispose the first flame opening for discharging the high-concentration gas adjacent to the second flame opening for discharging the low-concentration gas.

Incidentally, although reference marks and numeral are provided in the appended claims for the purpose of facilitating reference to the accompanying drawings, it is to be understood that these are not to limit the scope of the invention to those constructions illustrated in the drawings.

What is claimed is:

1. A gas burner comprising:

a burner case containing:

a plurality of first flame openings including means (F1) for discharging a high-concentration mixture gas containing gas containing a fuel gas and combustion air, said high-concentration mixture gas having a first air excess ration;

a plurality of second flame openings including means (F2) for discharging a low-concentration mixture gas having a second air excess ratio higher than said first air excess ratio;

said first flame openings (F1) and said second flame openings (F2) being arranged alternately with each other to form an array of opening; and a plurality of third flame openings (F3) disposed at selected peripheral portions of said second flame openings (F2) not adjacent one said first flame openings including means (F1), said third flame openings (F3) discharging an auxiliary high-concentration gas having an air excess ratio lower than that of said low-concentration mixture gas.

2. The gas burner as claimed in claim 1, wherein said third flame openings (F3) are disposed at opposed ends of said array of openings of said first and second flame openings (F1) and (F2), said third flame openings (F3) having the identical configurations as said first flame openings (F1).

3. The gas burner as claimed in claim 1, wherein said third flame opening (F3) is a portion of said first flame openings (F1) extending at opposed sides of said second flame openings (F2) in the array of openings of said first and second flame openings (F1) and (F2).

4. The gas burner as claimed in claim 1, wherein said third flame openings (F3) are disposed at least in the vicinity of outer periphery of said second flame openings (F2) at opposed sides of said array of openings of said first and second flame openings (F1) and (F2).

5. The gas burner as claimed in claim 1, further comprising:

wall portions (W) for blocking inlet of exterior atmosphere onto said first and second flame openings (F1) and (F2), said wall portions (W) being provided at opposed sides of said array of openings of said first and second flame openings (F1) and (F2).

6. The gas burner as claimed in claim 1, further comprising:

fuel gas mixing means for adjusting said high concentration mixture gas to a fuel gas concentration within a stable and self-combustible range and adjusting said low concentration mixture gas to a fuel gas concentration below said stable self combustion range, respectively.

7. The gas burner of claim 1, wherein each of said second flame openings have a rectifying member for partitioning the interior of said flame openings into a plurality of sections and wherein said rectifying members having a width not greater than 2 mm, and wherein adjacent parts of said first flame openings are spaced apart with an interdistance not less than 8 mm.

8. The gas burner as claimed in claim 7, wherein substantially all of said sections partitioned by said rectifying member have a width between 0.7 and 1.3 mm, substantially all of adjacent parts of said first flame openings being spaced apart within an interdistance between 20 and 40 mm.

9. The gas burner as claimed in claim 8, further comprising:

fuel gas mixing means for adjusting said high concentration mixture gas to a fuel gas concentration within a stable and self-combustible range and adjusting said low-concentration mixture gas to a fuel gas concentration below said stable self-combustible range, respectively.

10. The gas burner as claimed in claim 7, further comprising:

fuel gas mixing means for adjusting said high concentration mixture gas to a fuel gas concentration within a stable and self-combustible range, respectively.

11. The gas burner as claimed in claim 10, wherein a first gas supply passage supplies therethrough a first gas selected from the group consisting of a fuel gas, a combustion air and a mixture gas of the fuel gas and the combustion air whereas a second gas supply passage supplies therethrough a second gas selected from said two remaining group elements.

* * * * *